US009651034B2

(12) United States Patent
Nakaima et al.

(10) Patent No.: US 9,651,034 B2
(45) Date of Patent: May 16, 2017

(54) VARIABLE DISPLACEMENT SWASH-PLATE COMPRESSOR

(71) Applicant: KABUSHIKI KAISHA TOYOTA JIDOSHOKKI, Aichi-ken (JP)

(72) Inventors: Hiroyuki Nakaima, Kariya (JP); Shinya Yamamoto, Kariya (JP); Hideharu Yamashita, Kariya (JP); Kengo Sakakibara, Kariya (JP); Yusuke Yamazaki, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 0 days.

(21) Appl. No.: 14/947,191

(22) Filed: Nov. 20, 2015

(65) Prior Publication Data

US 2016/0153438 A1 Jun. 2, 2016

(30) Foreign Application Priority Data

Nov. 27, 2014 (JP) ..... 2014-239928

(51) Int. Cl.

| | |
|---|---|
| ***F01B 31/14*** | (2006.01) |
| ***F04B 27/14*** | (2006.01) |
| ***F04B 27/08*** | (2006.01) |
| ***F04B 27/22*** | (2006.01) |
| ***F04B 27/10*** | (2006.01) |
| ***F04B 27/18*** | (2006.01) |

(52) U.S. Cl.

CPC ..... *F04B 27/14* (2013.01); *F04B 27/0895* (2013.01); *F04B 27/1054* (2013.01); *F04B 27/1072* (2013.01); *F04B 27/18* (2013.01); *F04B 27/22* (2013.01)

(58) Field of Classification Search

CPC ..... F04B 1/295; F04B 27/18; F04B 27/22

See application file for complete search history.

(56) References Cited

U.S. PATENT DOCUMENTS

| | | | | |
|---|---|---|---|---|
| 4,037,993 | A | 7/1977 | Roberts | |
| 4,061,443 | A | 12/1977 | Black et al. | |
| 4,105,370 | A | 8/1978 | Brucken et al. | |
| 5,370,503 | A | 12/1994 | Terauchi | |
| 6,957,604 | B1 * | 10/2005 | Tiedemann | F04B 1/295 91/506 |

FOREIGN PATENT DOCUMENTS

| | | |
|---|---|---|
| JP | 52-131204 | 11/1977 |

* cited by examiner

*Primary Examiner* — Michael Leslie

(74) *Attorney, Agent, or Firm* — Greenblum & Bernstein, P.L.C.

(57) ABSTRACT

A variable displacement swash-plate compressor includes an actuator that is configured to change the inclination angle of a swash plate. The actuator includes a movable body that moves along a drive shaft axis. The movable body includes an acting portion that is configured to push the swash plate with the pressure in a control pressure chamber. The swash plate includes a receiving portion that contacts and is pushed by the acting portion. The acting portion and the receiving portion contact each other at an acting position. A drive-shaft-parallel line segment is defined that contains the acting position and connects a proximal end of the acting portion and a proximal end of the receiving portion to each other, while extending in parallel with the drive shaft axis. The drive-shaft-parallel line segment is shorter when the inclination angle of the swash plate is maximized than when the inclination angle is minimized.

8 Claims, 15 Drawing Sheets

VARIABLE DISPLACEMENT SWASH-PLATE COMPRESSOR

BACKGROUND OF THE INVENTION

The present invention relates to a variable displacement swash-plate compressor.

Japanese Laid-Open Patent Publication No. 52-131204 discloses a conventional variable displacement swash-plate compressor (hereinafter, referred to as a compressor). The compressor includes a swash plate chamber, cylinder bores, a suction chamber, and a discharge chamber, which are provided in the housing. The housing rotationally supports a drive shaft with the distal end of the drive shaft projecting out of the housing. The swash plate chamber accommodates a swash plate, which is rotational through rotation of the drive shaft. A link mechanism is located between the drive shaft and the swash plate. The link mechanism allows the inclination angle of the swash plate to be changed. The inclination angle is the angle of the swash plate in relation to a direction perpendicular to the axis of the drive shaft. Each cylinder bore reciprocally accommodates a piston. A conversion mechanism reciprocates each of the pistons in the associated one of the cylinder bores by the stroke corresponding to the inclination angle through rotation of the swash plate. The inclination angle of the swash plate is changed by an actuator. The actuator is controlled by a control mechanism. The control mechanism includes a pressure regulation valve.

The link mechanism includes a lug member, a hinge ball, and a link. The lug member is located in the swash plate chamber and is fixed to the drive shaft. The hinge ball is fitted about the drive shaft to be arranged between the swash plate and the drive shaft. The hinge ball includes a spherical portion, which slidably contacts the swash plate, and a receiving portion, which faces the actuator. The link is provided between the lug member and the swash plate. The link connects the swash plate to the lug member, so that the swash plate is permitted to pivot.

The actuator includes the lug member, a movable body, and a control pressure chamber. The movable body has a cylindrical shape that is coaxial with the drive shaft axis. The movable body is fitted about the drive shaft to be arranged between the lug member and the hinge ball. The movable body changes the inclination angle of the swash plate by moving along the axis of the drive shaft. The movable body includes a large diameter portion and a small diameter portion, which extends from the large diameter portion toward the hinge ball. The side of the small diameter portion that faces the hinge ball serves as an acting surface, which contacts the receiving portion at an acting position. When the acting portion and the receiving contact each other, the movable body is engaged with the swash plate via the hinge ball. The control pressure chamber, which is defined by the lug member and the movable body, uses its internal pressure to move the movable body.

In this compressor, when the control mechanism connects the discharge chamber and the control pressure chamber with each other using the pressure regulation valve, the pressure in the control pressure chamber is increased. This moves the movable body along the axis of the drive shaft and causes the acting portion to press the receiving portion along the axis of the drive shaft. Accordingly, the hinge ball is moved along the axis of the drive shaft, and the swash plate slides on the hinge ball in the direction reducing the inclination angle. This allows the displacement of the compressor per rotation of the drive shaft to be reduced.

However, in the above described conventional compressor, the stroke of the movable body required for changing the inclination angle is large, which results in an increased axial length of the compressor. This restricts the size reduction of the compressor.

SUMMARY OF THE INVENTION

An objective of the present invention is to provide a variable displacement swash-plate compressor that has a reduced size.

To achieve the foregoing objective and in accordance with one aspect of the present invention, a variable displacement swash-plate compressor is provided that includes a housing having a swash plate chamber and a cylinder bore, a drive shaft that is rotationally supported by the housing, a swash plate that is rotational in the swash plate chamber by rotation of the drive shaft, a link mechanism, a piston, a conversion mechanism, an actuator, and a control mechanism. The link mechanism is arranged between the drive shaft and the swash plate and allows an inclination angle of the swash plate to be changed with respect to a direction perpendicular to a drive shaft axis of the drive shaft. The piston is reciprocally received in the cylinder bore. The conversion mechanism causes the piston to reciprocate in the cylinder bore by a stroke corresponding to the inclination angle of the swash plate through rotation of the swash plate. The actuator is configured to change the inclination angle. The control mechanism controls the actuator. The link mechanism includes a lug member that is located in the swash plate chamber and is fixed to the drive shaft and a transmitting member that transmits rotation of the lug member to the swash plate. The actuator includes the lug member, a movable body that is configured to rotate integrally with the swash plate and to move along the drive shaft axis, thereby changing the inclination angle, and a control pressure chamber that is defined by the lug member and the movable body and is configured such that pressure in the control pressure chamber is changed by the control mechanism to move the movable body. The movable body includes an acting portion that protrudes toward the swash plate and is configured to push the swash plate with the pressure in the control pressure chamber. The swash plate includes a receiving portion that protrudes toward the movable body, wherein the receiving portion contacts and is pushed by the acting portion. The acting portion and the receiving portion contact each other at an acting position. A drive-shaft-parallel line segment is defined that contains the acting position and connects a proximal end of the acting portion and a proximal end of the receiving portion to each other, while extending in parallel with the drive shaft axis. The drive-shaft-parallel line segment is shorter when the inclination angle is maximized than when the inclination angle is minimized.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First and second embodiments will now be described with reference to the drawings. Compressors according to the first and second embodiments are variable displacement swash-plate compressors with single-headed pistons. These compressors are installed in vehicles and are each included in the refrigeration circuit in the air conditioner for the vehicle.

First Embodiment

Figure 1:
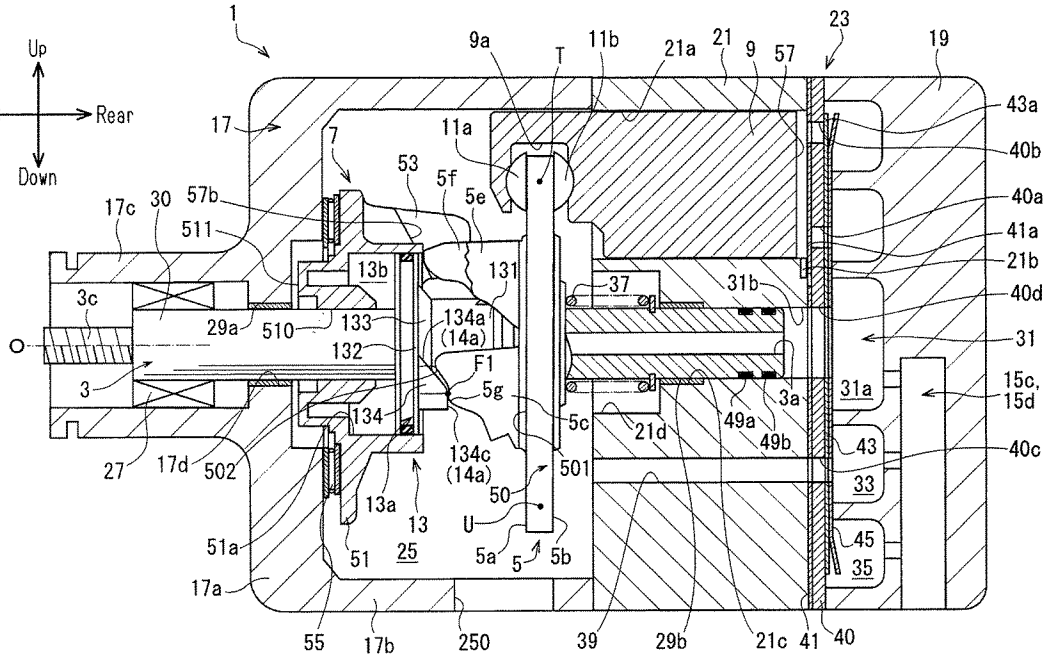
FIG. 1 is a cross-sectional view of a compressor according to a first embodiment at the minimum displacement.
Figure 2:
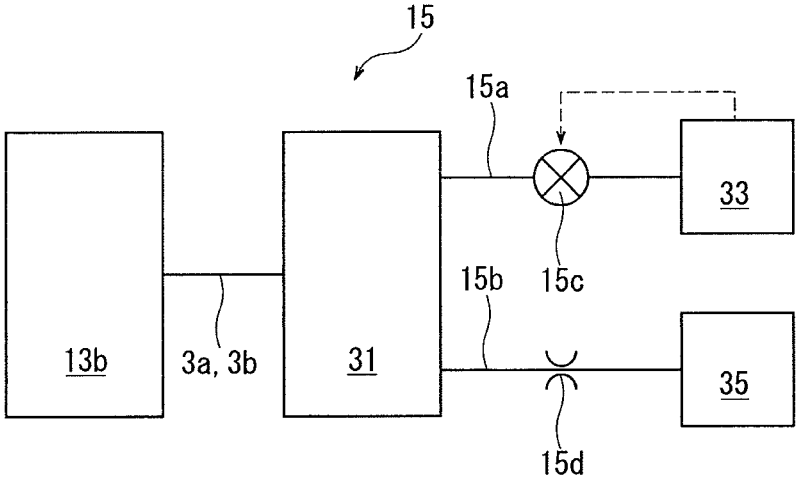
FIG. 2 is a schematic diagram showing the control mechanism of the compressor according to the first embodiment.

As shown in FIG. 1, the compressor according to the first embodiment includes a housing 1, a drive shaft 3, a swash plate 5, a link mechanism 7, pistons 9, pairs of shoes 11*a*, 11*b*, an actuator 13, and a control mechanism 15, which is illustrated in FIG. 2.

As shown in FIG. 1, the housing 1 has a front housing member 17 at a front position in the compressor, a rear housing member 19 at a rear position in the compressor, and a cylinder block 21 and a valve assembly plate 23, which are arranged between the front housing member 17 and the rear housing member 19.

The front housing member 17 includes a front wall 17*a*, which extends in the vertical direction of the compressor on the front side, and a circumferential wall 17*b*, which is integrated with the front wall 17*a* and extends rearward from the front of the compressor. The front housing member 17 has a substantially cylindrical cup shape with the front wall 17*a* and the circumferential wall 17*b*. Furthermore, the front wall 17*a* and the circumferential wall 17*b* define a swash plate chamber 25 in the front housing member 17.

The front wall 17*a* has a boss 17*c*, which projects forward. The boss 17*c* accommodates a shaft sealing device 27. The boss 17*c* has a first shaft hole 17*d*, which extends in the front-rear direction of the compressor. The first shaft hole 17*d* accommodates a first slide bearing 29*a*.

The circumferential wall 17*b* has an inlet 250, which communicates with the swash plate chamber 25. The swash plate chamber 25 is connected to a non-illustrated evaporator through the inlet 250. Since low-pressure refrigerant gas that has passed through the evaporator flows into the swash plate chamber 25 via the inlet 250, the pressures in the swash plate chamber 25 is lower than the pressure in a discharge chamber 35, which will be discussed below.

A part of the control mechanism 15 is received in the rear housing member 19. The rear housing member 19 includes a first pressure regulation chamber 31*a*, a suction chamber 33, and the discharge chamber 35. The first pressure regulation chamber 31*a* is located in the central part of the rear housing member 19. The discharge chamber 35 has an annular shape and is located in a radially outer part of the rear housing member 19. Also, the suction chamber 33 has an annular shape between the first pressure regulation chamber 31*a* and the discharge chamber 35 in the rear housing member 19. The discharge chamber 35 is connected to a non-illustrated outlet.

The cylinder block 21 includes cylinder bores 21*a*, the number of which is the same as that of the pistons 9. The cylinder bores 21*a* are arranged at equal angular intervals in the circumferential direction. The front end of the each cylinder bore 21*a* communicates with the swash plate chamber 25. The cylinder block 21 also includes retainer grooves 21*b*, which limit the lift of suction reed valves 41*a*, which will be discussed below.

The cylinder block 21 further includes a second shaft hole 21*c*, which communicates with the swash plate chamber 25 and extends in the front-rear direction of the compressor. The second shaft hole 21*c* accommodates a second slide bearing 29*b*. The first slide bearing 29*a* and the second slide bearing 29*b* may be replaced by rolling-element bearings.

The cylinder block 21 further has a spring chamber 21*d*. The spring chamber 21*d* is located between the swash plate chamber 25 and the second shaft hole 21*c*. The spring chamber 21*d* accommodates a restoration spring 37. The restoration spring 37 urges the swash plate 5 forward of the swash plate chamber 25 when the inclination angle is minimized. The cylinder block 21 also includes a suction passage 39, which communicates with the swash plate chamber 25.

The valve assembly plate 23 is located between the rear housing member 19 and the cylinder block 21. The valve assembly plate 23 includes a valve base plate 40, a suction valve plate 41, a discharge valve plate 43, and a retainer plate 45.

The valve base plate 40, the discharge valve plate 43, and the retainer plate 45 include suction ports 40*a*, the number of which is equal to that of the cylinder bores 21*a*. Furthermore, the valve base plate 40 and the suction valve plate 41 include discharge ports 40*b*, the number of which is equal to that of the cylinder bores 21*a*. The cylinder bores 21*a* communicate with the suction chamber 33 through the suction ports 40*a* and communicate with the discharge chamber 35 through the discharge ports 40*b*. Furthermore, the valve base plate 40, the suction valve plate 41, the discharge valve plate 43, and the retainer plate 45 include a first communication hole 40*c* and a second communication hole 40*d*. The first communication hole 40*c* connects the suction chamber 33 to the suction passage 39. This causes the swash plate chamber 25 to communicate with the suction chamber 33.

The suction valve plate 41 is provided on the front surface of the valve base plate 40. The suction valve plate 41 includes suction reed valves 41*a*, which are allowed to selectively open and close the suction ports 40*a* by elastic deformation. The discharge valve plate 43 is located on the rear surface of the valve base plate 40. The discharge valve plate 43 includes discharge reed valves 43*a*, which are allowed to selectively open and close the discharge ports 40*b* by elastic deformation. The retainer plate 45 is provided on the rear surface of the discharge valve plate 43. The retainer plate 45 limits the maximum opening degree of the discharge reed valves 43*a*.

The drive shaft 3 has a cylindrical outer circumferential surface 30. The drive shaft 3 is inserted in the boss 17*c* toward the rear of the housing 1. The front portion of the drive shaft 3 is supported by the shaft sealing device 27 in the boss 17*c* and is supported by the first slide bearing 29*a* in the first shaft hole 17*d*. The rear portion of the drive shaft 3 is supported by the second slide bearing 29*b* in the second shaft hole 21*c*. In this manner, the drive shaft 3 is supported by the housing 1 to be rotational about the drive shaft axis O. The second shaft hole 21*c* and the rear end of the drive shaft 3 define a second pressure regulation chamber 31*b*. The second pressure regulation chamber 31*b* communicates with the first pressure regulation chamber 31*a* through the second communication hole 40*d*. The first and second pressure regulation chambers 31*a*, 31*b* constitute a pressure regulation chamber 31.

O-rings 49*a*, 49*b* are provided on the rear end of the drive shaft 3. The O-rings 49*a*, 49*b* are located between the drive shaft 3 and the second shaft hole 21*c* to seal off the swash plate chamber 25 and the pressure regulation chamber 31 from each other.

The link mechanism 7, the swash plate 5, and the actuator 13 are mounted on the drive shaft 3. The link mechanism 7 includes first and second swash plate arms 5*e*, 5*f* provided on the swash plate 5 shown in FIG. 3, a lug plate 51 shown in FIG. 4, and first and second lug arms 53*a*, 53*b* provided on the lug plate 51. The first and second swash plate arms 5*e*, 5*f* correspond to transmitting members. The lug plate 51 corresponds to a lug member. For illustrative purposes, part of the first swash plate arm 5*e* is omitted by using a break line in FIG. 1. The same applies to FIGS. 8 to 10, 14, 18, and 19, which will be discussed below.

Figure 3:
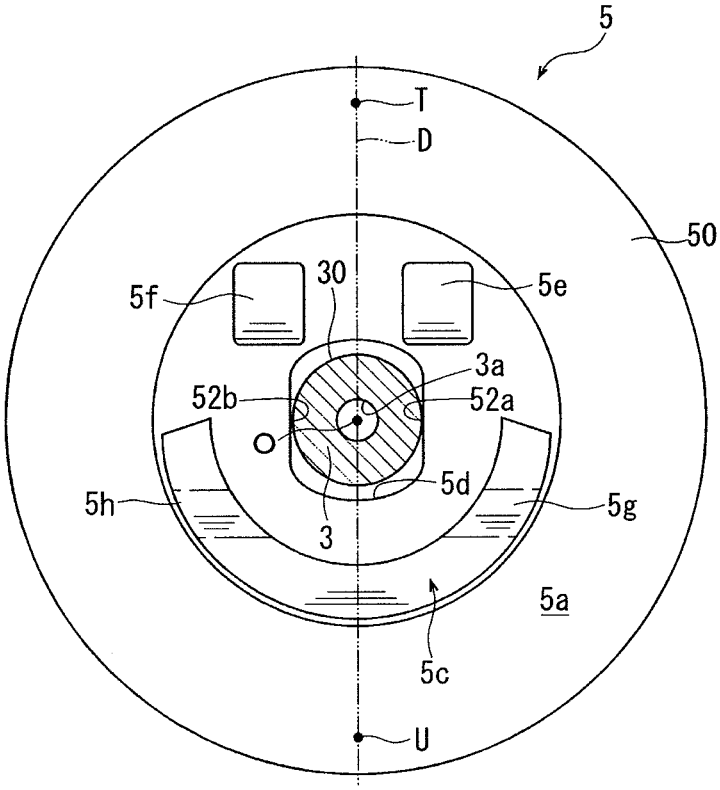
FIG. 3 is a schematic front view of the swash plate of the compressor according to the first embodiment.

As shown in FIG. 3, the swash plate 5 has a swash plate main portion 50, a swash plate weight 5*c*, and the first and second swash plate arms 5*e*, 5*f*.

Figure 8:
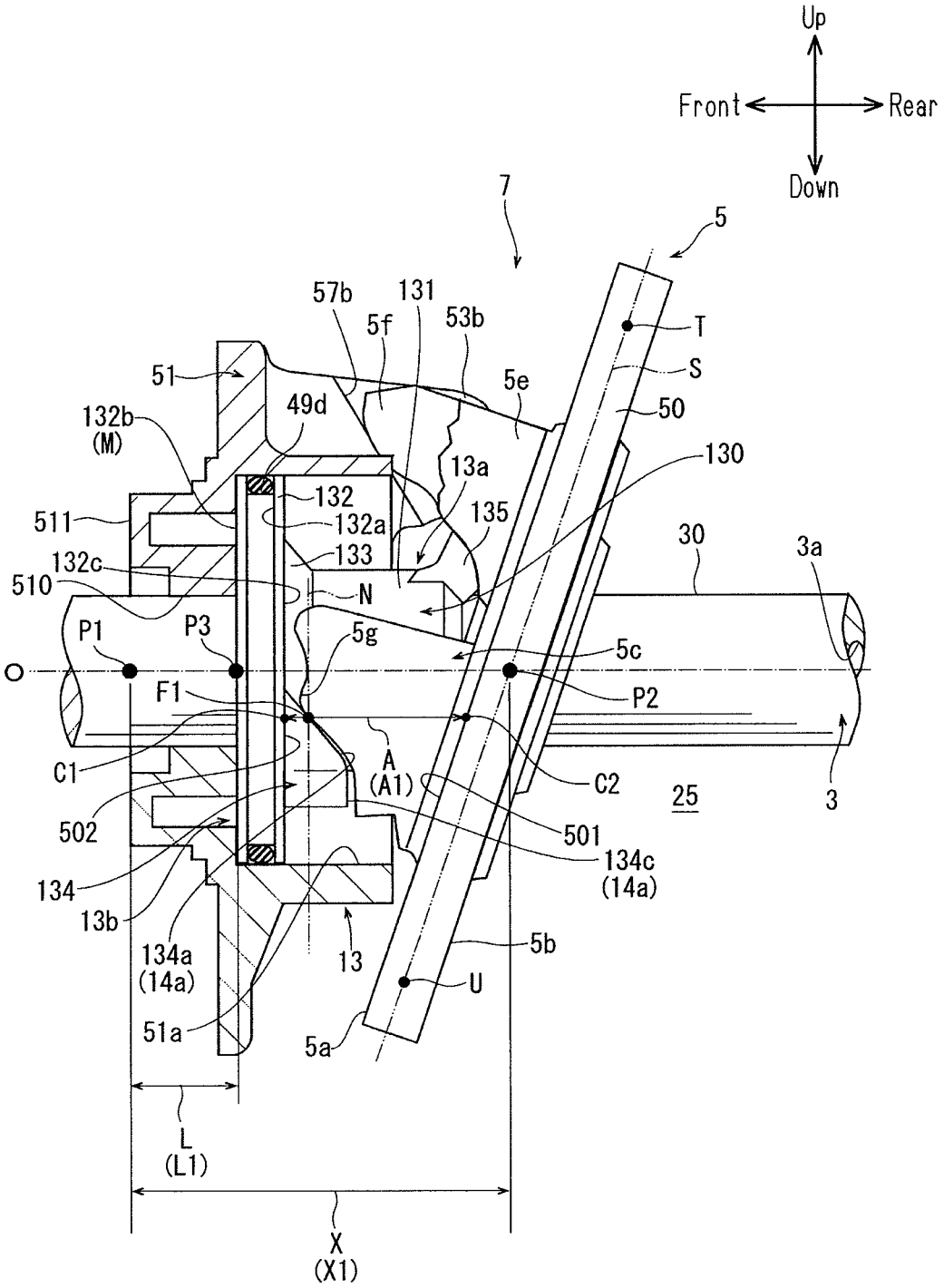
FIG. 8 is an enlarged partial cross-sectional view of a first drive-shaft-parallel line segment when the displacement is maximized in the compressor according to the first embodiment.

The swash plate main portion 50 is shaped as a flat annular plate and has a front surface 5*a* and a rear surface 5*b*. The front surface 5*a* corresponds to a swash plate surface. A top dead center associated part T for positioning each piston 9 at the top dead center and a bottom dead center associated part U for positioning each piston 9 at the bottom dead center are defined on the swash plate main portion 50. Also, as shown in FIG. 3, an imaginary plane D is defined in this compressor. The imaginary plane D includes the top dead center associated part T, the bottom dead center associated part U, and the drive shaft axis O. Further, as shown in FIG. 8, the swash plate main portion 50 includes a swash plate reference plane S for determining the inclination angle of the swash plate 5 in relation to a direction perpendicular to the drive shaft axis O. The swash plate reference plane S is parallel with the front surface 5*a* and the rear surface 5*b*.

As shown in FIG. 3, the swash plate main portion 50 includes a through hole 5*d*. The drive shaft 3 is inserted in the through hole 5*d*. Two flat guide surfaces 52*a*, 52*b* are provided in the through hole 5*d*. When the drive shaft 3 is inserted in the through hole 5*d*, the guide surfaces 52*a*, 52*b* contact the outer circumferential surface 30 of the drive shaft 3.

The swash plate weight 5*c* is provided on the front surface 5*a* at a position closer to the bottom dead center associated part U than the drive shaft axis O. That is, the swash plate weight 5*c* is located between the drive shaft axis O and the bottom dead center associated part U. The swash plate weight 5*c* has a substantially semi-circular cylindrical shape and extends from a proximal end 501, which is a part of the front surface 5*a*, toward a movable body weight 134 of the movable body 13*a*, which will be discussed below. The swash plate weigh 5*c* adjusts the weight balance of the swash plate 5.

The swash plate weight 5*c* has, at its distal end, first and second protrusions 5*g*, 5*h* as shown in FIG. 3.

The first protrusion 5*g* and the second protrusion 5*h* are provided on the swash plate weight 5*c* at positions on opposite sides of the imaginary plane D, and project forward from the swash plate 5, that is, toward the actuator 13. The first and second protrusions 5*g*, 5*h* each have an arcuate shape with a generatrix extending in a direction perpendicular to the imaginary plane D. The swash plate weight 5*c* contacts, via the first and second protrusions 5*g*, 5*h*, first and second acting portions 14*a*, 14*b*, which will be discussed below, at first and second acting positions F1, F2. That is, the swash plate weight 5*c* serves as a receiving portion, while adjusting the weight balance of the swash plate 5.

The first and second swash plate arms 5*e*, 5*f* are arranged on the front surface 5*a* at positions closer to the top dead center associated part T than the drive shaft axis O. The first swash plate arm 5*e* and the second swash plate arm 5*f* are arranged on the front surface 5*a* at positions on opposite sides of the imaginary plane D. As shown in FIG. 1, the first and second swash plate arms 5*e*, 5*f* extend from the front surface 5*a* toward the lug plate 51. For illustrative purposes, the shapes of the swash plate weight 5*c* and the first and second swash plate arms 5*e*, 5*f*, as well as the shapes of the first and second protrusions 5*g*, 5*h*, are simplified in FIG. 3.

Figure 4:
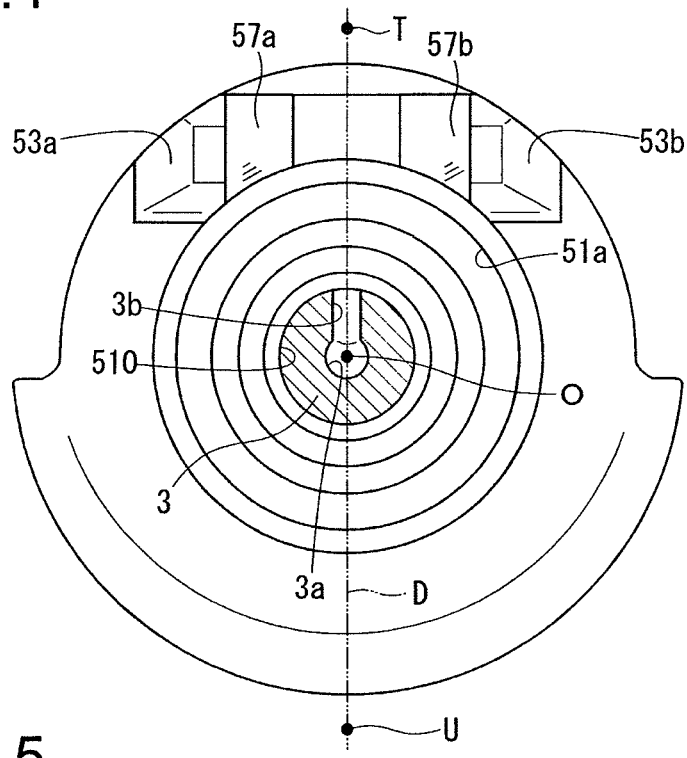
FIG. 4 is a rear view of the lug plate of the compressor according to the first embodiment.

As shown in FIG. 4, the lug plate 51 has a substantially annular shape with a through hole 510. The drive shaft 3 is press-fitted in the through hole 510, so that the lug plate 51 rotates integrally with the drive shaft 3. As shown in FIG. 1, a thrust bearing 55 is located between the lug plate 51 and the front wall 17*a*.

Figure 5:
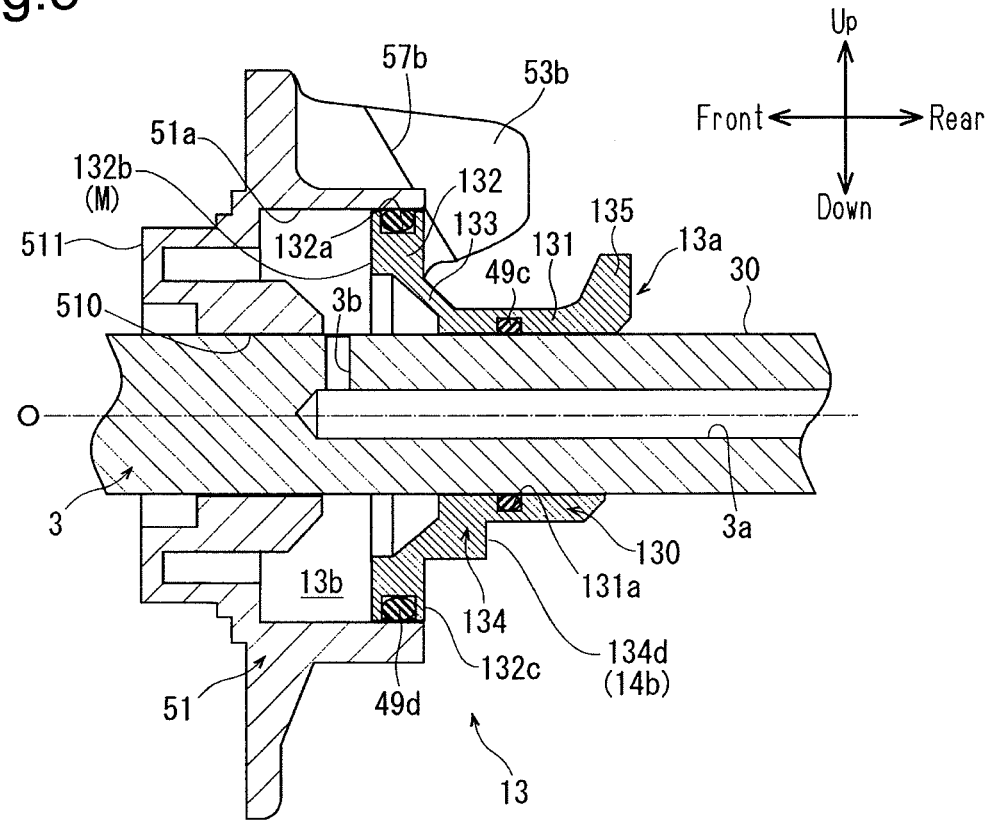
FIG. 5 is an enlarged partial cross-sectional view showing the lug plate and the movable body of the compressor according to the first embodiment.

As shown in FIG. 5, the lug plate 51 has a recessed cylinder chamber 51*a*. The cylinder chamber 51*a* has a cylindrical shape that is coaxial the drive shaft axis O and extends along the drive shaft axis O toward the front end face 511 of the lug plate 51. The cylinder chamber 51*a* communicates with the swash plate chamber 25 at the rear.

As shown in FIG. 4, the first lug arm 53*a* and the second lug arm 53*b* are provided on the lug plate 51 at positions on opposite sides of the imaginary plane D. On the lug plate 51, the first and second lug arms 53*a*, 53*b* are located at positions closer to the top dead center associated part T on the swash plate main portion 50 than the drive shaft axis O and extend from the lug plate 51 toward the swash plate 5. That is, the first and second lug arms 53*a*, 53*b* are located between the drive shaft axis O and the top dead center associated part T on the lug plate 51.

The lug plate 51 has first and second guide surfaces 57*a*, 57*b* between the first and second lug arms 53*a*, 53*b*. The first guide surface 57*a* and the second guide surface 57*b* are also located on opposite sides of the imaginary plane D. As shown in FIG. 1, the second guide surface 57*b* is inclined such that the distance from the swash plate 5 gradually decreases from the outer circumference of the lug plate 51 toward the cylinder chamber 51*a*. The first guide surface 57*a* has the same shape as the second guide surface 57*b*.

In this compressor, the first and second swash plate arms 5*e*, 5*f* are inserted between the first and second lug arms 53*a*, 53*b* to mount the swash plate 5 to the drive shaft 3. The lug plate 51 and the swash plate 5 are thus coupled to each other with the first and second swash plate arms 5*e*, 5*f* located between the first and second lug arms 53*a*, 53*b*. When rotation of the lug plate 51 is transmitted from the first and second lug arms 53*a*, 53*b* to the first and second swash plate arms 5*e*, 5*f*, the swash plate 5 rotates with the lug plate 51 in the swash plate chamber 25.

Since the first and second swash plate arms 5*e*, 5*f* are located between the first and second lug arms 53*a*, 53*b*, the distal end of the first swash plate arm 5*e* contacts the first guide surface 57*a*, and the distal end of the second swash plate arm 5*f* contacts the second guide surface 57*b*. The first and second swash plate arms 5*e*, 5*f* slide on the first and second guide surfaces 57*a*, 57*b*, respectively. Accordingly, the swash plate 5 is allowed to change its inclination angle, which is defined by the swash plate reference plane S, between the minimum inclination angle shown in FIGS. 1 and 10 and the maximum inclination angle shown in FIG. 8, while substantially maintaining the position of the top dead center associated part T.

As shown in FIG. 5, the actuator 13 includes the lug plate 51, a movable body 13*a*, and a control pressure chamber 13*b*.

Figure 6:
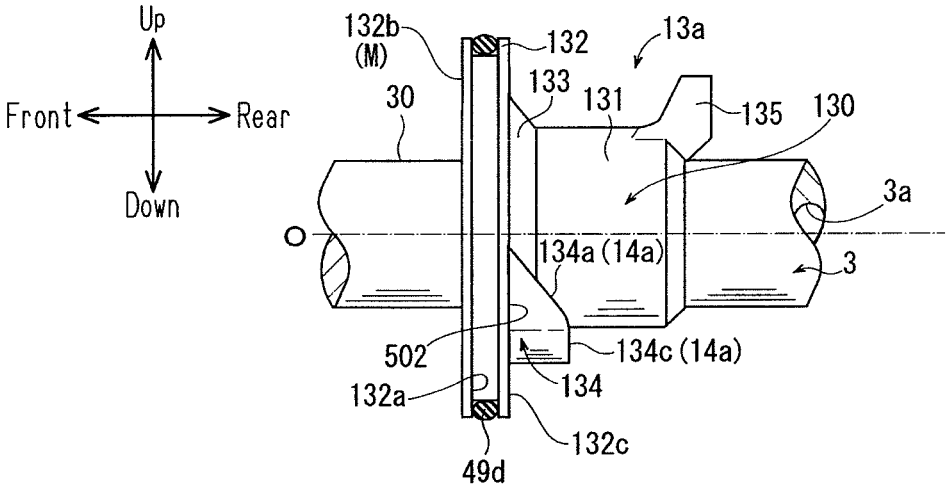
FIG. 6 is a side view of the movable body of the compressor according to the first embodiment.

As shown in FIG. 6, the movable body 13*a* is fitted about the drive shaft 3. The movable body 13*a* is thus located between the lug plate 51 and the swash plate 5 to move along the drive shaft axis O while sliding on the drive shaft 3. The movable body 13*a* has a substantially cylindrical shape coaxial with the drive shaft 3. Specifically, the movable body 13*a* includes a movable body main portion 130, a movable body weight 134, and a rotation stopper 135.

The movable body main portion 130 includes a first cylindrical portion 131, a second cylindrical portion 132, and a coupling portion 133. The first cylindrical portion 131 is located at a position facing the swash plate 5 in the movable body 13*a* and extends along the drive shaft axis O. The first cylindrical portion 131 has the smallest diameter in the movable body main portion 130. As shown in FIG. 5, a ring groove 131*a* is provided in the inner circumferential surface of the first cylindrical portion 131. An O-ring 49*c* is fitted in the ring groove 131*a*. The second cylindrical portion 132 is located at a position on the movable body main portion 130 that faces the lug plate 51, that is, on in a front portion of the movable body 13*a*. The second cylindrical portion 132 has a diameter larger than that of the first cylindrical portion 131 and has the largest diameter in the movable body main portion 130. The second cylindrical portion 132 has a ring groove 132*a* in the outer circumferential surface. An O-ring 49*d* is fitted in the ring groove 132*a*.

The second cylindrical portion 132 also has a front end face 132*b* and a rear end face 132*c*. When the drive shaft 3 is passed through the movable body 13*a*, the front end face 132*b* and the rear end face 132*c* become perpendicular to the drive shaft axis O. The rear end face 132*c* corresponds to a movable body surface. When the movable body 13*a* is located between the lug plate 51 and the swash plate 5, the rear end face 132*c* faces the front surface 5*a* of the swash plate 5 as shown in FIG. 8. In this compressor, the front end face 132*b* is defined as a movable body reference plane M.

The coupling portion 133 has an outer diameter that gradually increases from the first cylindrical portion 131 toward the second cylindrical portion 132 and couples the first cylindrical portion 131 and the second cylindrical portion 132 to each other.

Figure 7:
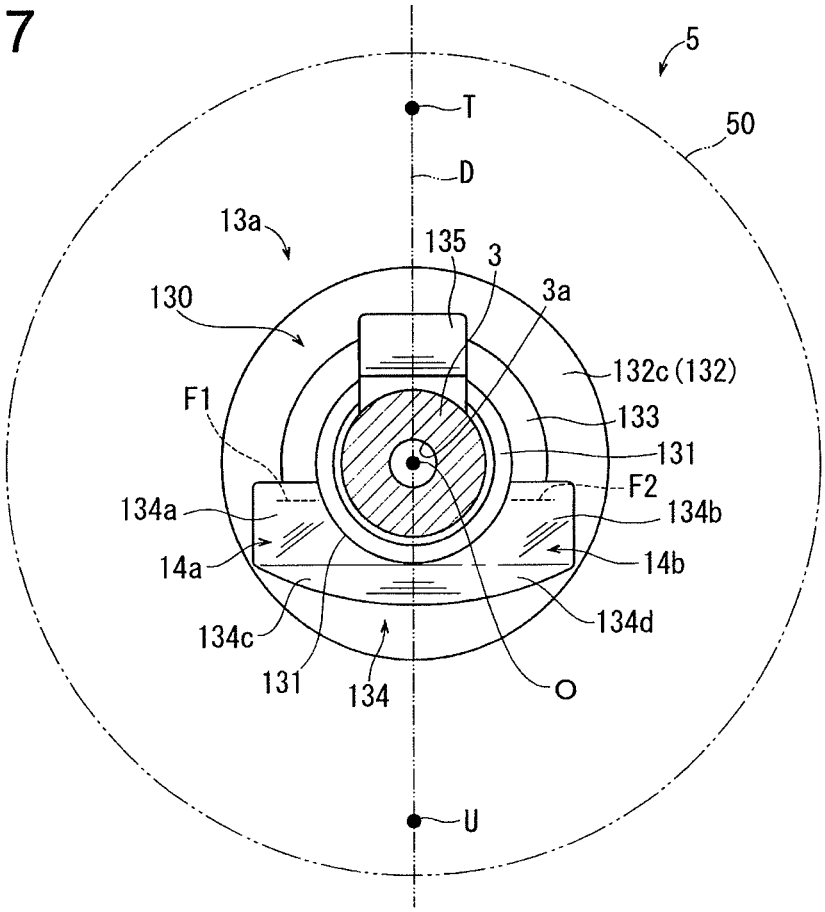
FIG. 7 is a rear view of the movable body of the compressor according to the first embodiment.

As shown in FIG. 7, the movable body weight 134 is located closer to the bottom dead center associate part U of the swash plate main portion 50 than the drive shaft axis O. That is, the movable body weight 134 is located between the drive shaft axis O and the bottom dead center associated part U. The movable body weight 134 has a semi-columnar shape. As shown in FIG. 1, the movable body weight 134 extends toward the swash plate 5 from a proximal end 502, which is a part of the rear end face 132*c* of the second cylindrical portion 132. The movable body weight 134 sets the center of gravity of the movable body 13*a* at a position closer to the bottom dead center associated part U than the drive shaft axis O.

As shown in FIG. 7, the movable body weight 134 has a symmetrical shape with respect to the imaginary plane D and has first and second inclined surfaces 134*a*, 134*b* and first and second vertical surfaces 134*c*, 134*d*. The first and second inclined surfaces 134*a*, 134*b* each correspond to an inclined section. The first inclined surface 134*a* and the first vertical surface 134*c* constitute a first acting portion 14*a*. The second inclined surface 134*b* and the second vertical surface 134*d* constitute a second acting portion 14*b*. The first and second acting portions 14*a*, 14*b* each correspond to an acting portion. That is, the movable body weight 134 serves as an acting portion, while adjusting the weight balance of the movable body 13*a*.

As shown in FIG. 8, an acting plane N is defined that contains acting positions F1, F2, which will be discussed below, and is perpendicular with the drive shaft axis O. The first inclined surface 134*a* is inclined in relation to the acting plane N. More specifically, as shown in FIG. 1, the first inclined surface 134*a* is inclined such that the distance from the drive shaft axis O gradually decreases from the swash plate 5 toward the proximal end 502 of the movable body weight 134. The second inclined surface 134*b*, which is shown in FIG. 7, has the same structure as the first inclined surface 134*a*.

The first vertical surface 134*c* is connected to an end of the first inclined surface 134*a* that faces the swash plate 5 and vertically extends toward the bottom dead center associated part U. The second vertical surface 134*d* is connected to an end of the second inclined surface 134*b* that faces the swash plate 5 and vertically extends toward the bottom dead center associated part U. The first vertical surface 134*c* and the second vertical surface 134*d* are continuous with each other and located on opposite sides of the imaginary plane D.

In this compressor, the first inclined surface 134*a* and the first vertical surface 134*c*, that is, the first acting portion 14*a* contacts the first protrusion 5*g* of the swash plate weight 5*c* shown in FIG. 3 at a first acting position F1 shown in FIG. 7. Since the first protrusion 5*g* has a cylindrical shape as described above, the first acting portion 14*a* and the first protrusion 5*g* make line contact at the first acting position F1. Likewise, the second acting portion 14*b* and the second protrusion 5*h* of the swash plate weight 5*c* shown in FIG. 3 make line contact at a second acting position F2 shown in FIG. 7.

Figure 9:
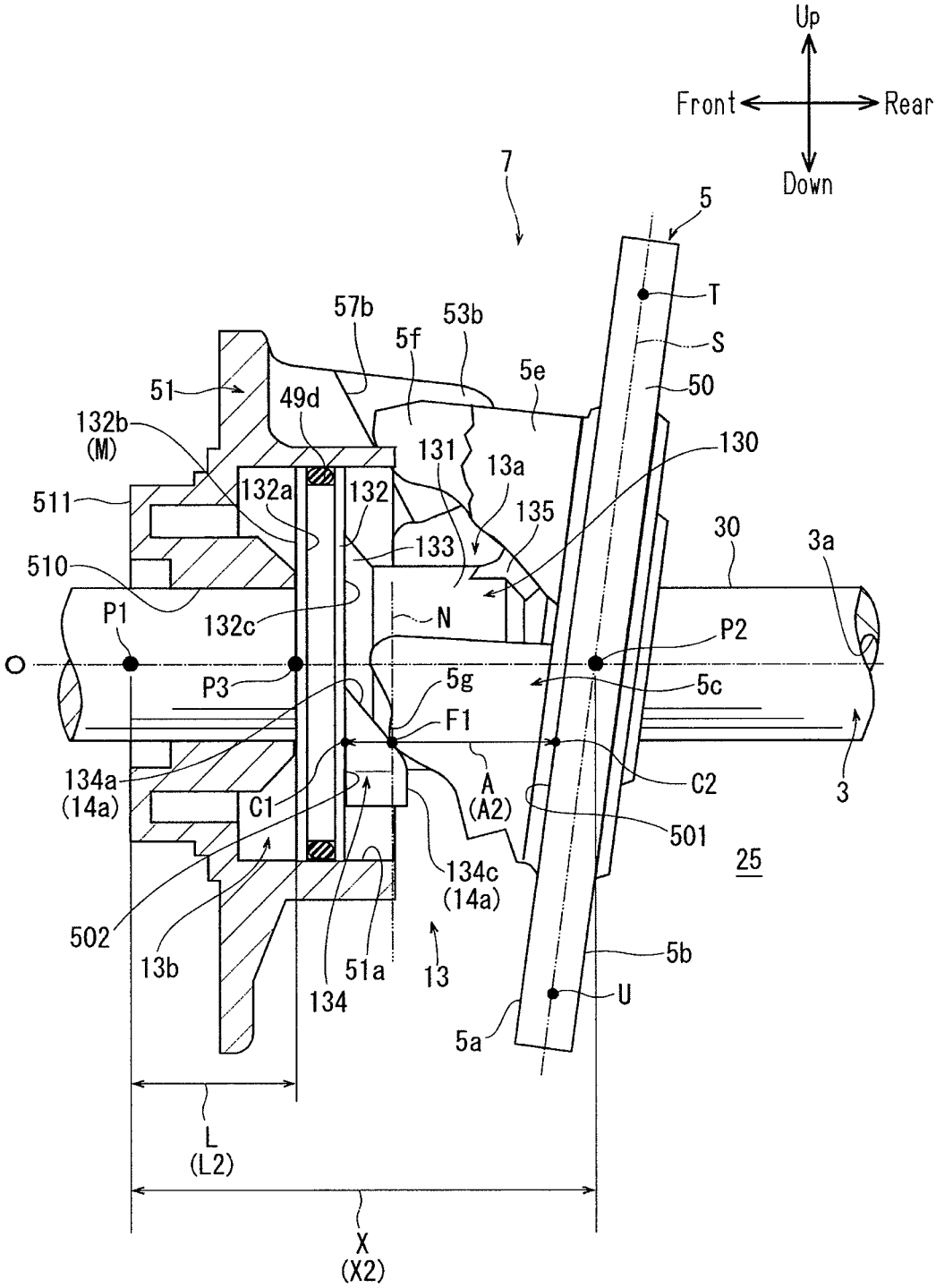
FIG. 9 is an enlarged partial cross-sectional view of the first drive-shaft-parallel line segment when the displacement is decreased from the maximum displacement in the compressor according to the first embodiment.
Figure 10:
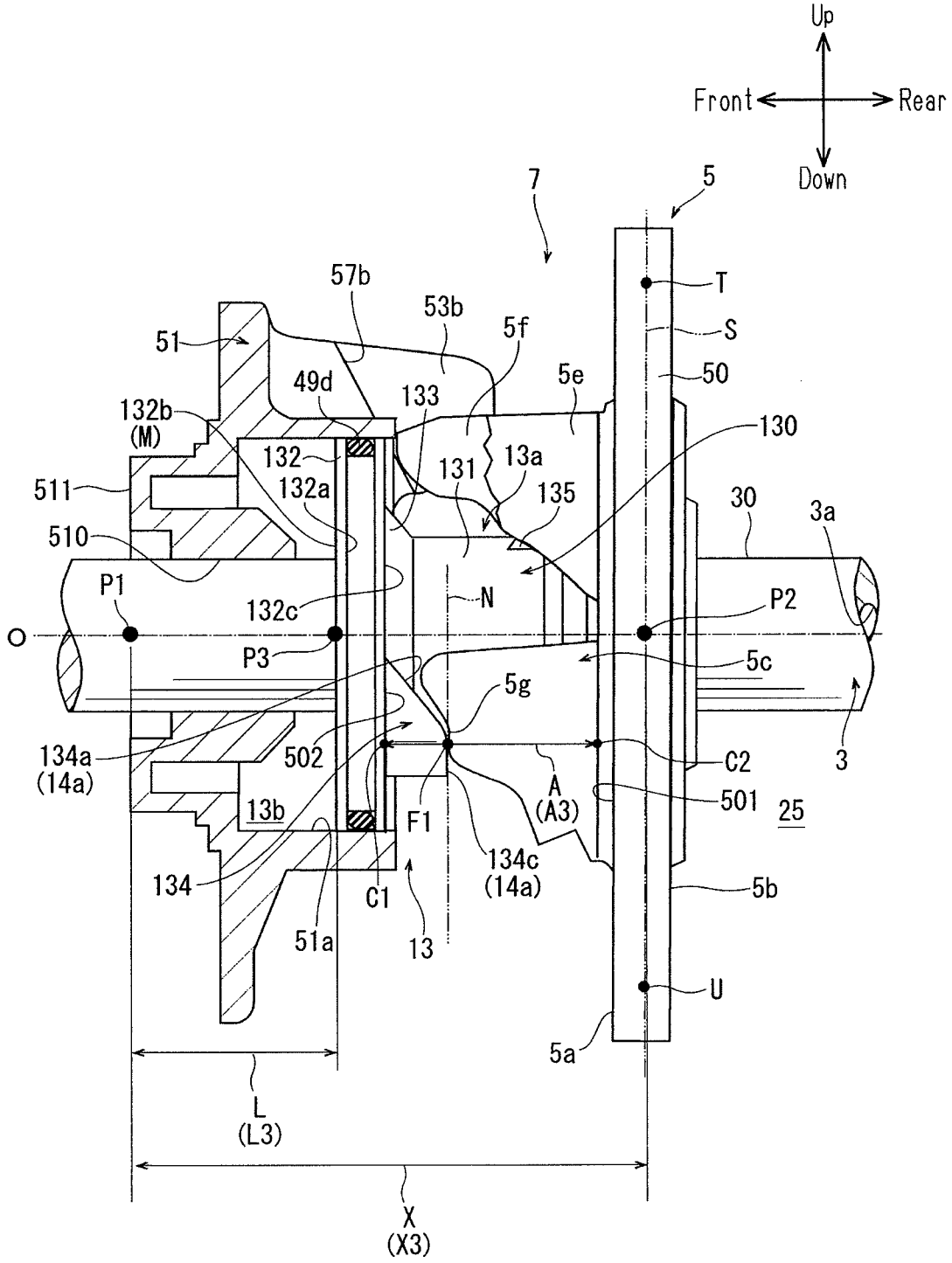
FIG. 10 is an enlarged partial cross-sectional view of a first drive-shaft-parallel line segment when the displacement is minimized in the compressor according to the first embodiment.

FIG. 7 shows a state in which the first acting position F1 is located on the first inclined surface 134*a*, and the second acting position F2 is located on the second inclined surface 134*b*. However, when the inclination angle of the swash plate 5 of this compressor changes, the first acting position F1 and the second acting position F2 are moved. That is, as shown in FIGS. 8 to 10, when the swash plate 5 is moved from the minimum inclination angle to the maximum inclination angle, the first acting position F1 is moved from the first vertical surface 134*c* to a position on the first inclined surface 134*a* that is close to the second cylindrical portion 132. Likewise, the second acting position F2 is moved from the second vertical surface 134*d* to a position on the second inclined surface 134*b* that is close to the second cylindrical portion 132. In this compressor, not only when the swash plate 5 is at the minimum inclination angle, but also when at the maximum inclination angle, the first and second acting positions F1, F2 are located at positions shifted closer to the bottom dead center associated part U than the drive shaft axis O. That is, the first and second acting positions F1, F2 are located between the drive shaft axis O and the bottom dead center associated part U.

As shown in FIG. 6, the rotation stopper 135 is located at a position on the first cylindrical portion 131 that faces the swash plate 5. The rotation stopper 135 has a rectangular shape as shown in FIG. 7 and extends from the outer circumferential surface of the first cylindrical portion 131 toward the top dead center associated part T of the swash plate main portion 50. The rotation stopper 135 is located between the first swash plate arm 5*e* and the second swash plate arm 5*f*, which are shown in FIG. 3. As the swash plate 5 rotates, the rotation stopper 135 contacts the first swash plate arm 5*e* or the second swash plate arm 5*f*. This allows the movable body 13*a* to be rotated integrally with the lug plate 51 and the swash plate 5 by rotation of the drive shaft 3.

As shown in FIG. 5, the control pressure chamber 13*b* is defined by the second cylindrical portion 132, the coupling portion 133, the cylinder chamber 51*a*, and the drive shaft 3. The control pressure chamber 13*b* and the swash plate chamber 25 are sealed off from each other by the O-rings 49*c*, 49*d*.

The drive shaft 3 has an axial passage 3*a* and a radial passage 3*b*. The axial passage 3*a* extends from the rear end of the drive shaft 3 toward the front end along the drive shaft axis O. The radial passage 3*b* extends in a radial direction from the front end of the axial passage 3*a* and opens in the outer circumferential surface of the drive shaft 3. As shown in FIG. 1, the rear end of the axial passage 3*a* communicates with the pressure regulation chamber 31. The radial passage 3*b* communicates with control pressure chamber 13*b* as shown in FIG. 5. The axial passage 3*a* and the radial passage 3*b* connect the pressure regulation chamber 31 to the control pressure chamber 13*b*.

As shown in FIG. 1, the drive shaft 3 has, at the front end, a threaded portion 3*c*. The drive shaft 3 is connected to a non-illustrated pulley or a non-illustrated electromagnetic clutch through the threaded portion 3*c*.

Each piston 9 is accommodated in the corresponding one of the cylinder bores 21*a* and is allowed to reciprocate in the cylinder bore 21*a*. Each piston 9 and the valve assembly plate 23 define a compression chamber 57 in the corresponding cylinder bore 21*a*.

Each piston 9 has an engaging portion 9*a*. Each engaging portion 9*a* accommodates a pair of hemispherical shoes 11*a*, 11*b*. The shoes 11*a*, 11*b* correspond to a conversion mechanism. Each shoe 11*a* slides on the front surface 5*a* of the swash plate main portion 50. In contrast, each shoe 11*b* slides on the rear surface 5*b* of the swash plate main portion 50. The swash plate main portion 50 thus actuates the shoes 11*a*, 11*b*. Accordingly, the shoes 11*a*, 11*b* convert rotation of the swash plate 5 into reciprocation of the pistons 9, and the pistons 9 reciprocate in the cylinder bores 21*a* by a stroke corresponding to the inclination angle defied by the swash plate reference plane S. Instead of providing the shoes 11*a*, 11*b*, a wobble plate type conversion mechanism may be employed in which a wobble plate is provided on the rear surface 5*b* of the swash plate main portion 50 via a thrust bearing, and the wobble plate and the pistons 9 are connected to each other with connecting rods.

As shown in FIG. 2, the control mechanism 15 includes a low-pressure passage 15*a*, a high-pressure passage 15*b*, a control valve 15*c*, an orifice 15*d*, the axial passage 3*a*, and the radial passage 3*b*.

The low-pressure passage 15*a* is connected to the pressure regulation chamber 31 and the suction chamber 33. The low-pressure passage 15*a*, the axial passage 3*a*, and the radial passage 3*b* connect the control pressure chamber 13*b*, the pressure regulation chamber 31, and the suction chamber 33 to one another. The high-pressure passage 15*b* is connected to the pressure regulation chamber 31 and the discharge chamber 35. The high-pressure passage 15*b*, the axial passage 3*a*, and the radial passage 3*b* connect the control pressure chamber 13*b*, the pressure regulation chamber 31, and the discharge chamber 35 to one another.

The control valve 15*c* is arranged in the low-pressure passage 15*a*. The low-pressure control valve 15*c* is allowed to adjust the opening degree of the low-pressure passage 15*a* based on the pressure in the suction chamber 33. The high-pressure passage 15*b* also has the orifice 15*d*.

In this compressor, a pipe connected to the evaporator is connected to the inlet 250 shown in FIG. 1, and a pipe connected to the condenser is connected to the outlet. The condenser is connected to the evaporator via a pipe and an expansion valve. These components, which include the compressor, the evaporator, the expansion valve, and the condenser, constitute the refrigeration circuit in the air conditioner for a vehicle. The illustration of the evaporator, the expansion valve, the condenser, and the pipes is omitted.

As shown in FIG. 8, a reference point P1 is defined on the drive shaft axis O of the drive shaft 3 in this compressor. Specifically, the reference point P1 is defined at position of the intersection of the drive shaft axis O and the front end face 511 of the lug plate 51. In addition to the swash plate reference plane S, a swash plate intersection P2 is defined in the swash plate 5. The swashplate intersection P2 is located at the position where the swash plate reference plane S and the drive shaft axis O intersect with each other. Further, in addition to the movable body reference plane M, a movable body intersection P3 is defined in the movable body 13*a*. The movable body intersection P3 is located at the position where the movable body reference plane M and the drive shaft axis O intersect with each other.

Also, the acting plane N is defined in the compressor. A movable body distance L between the reference point P1 and the movable body intersection P3 and a swash plate distance X between the reference point P1 and the swash plate intersection P2 are defined.

A first drive-shaft-parallel line segment A and a second drive-shaft-parallel line segment (not shown) are defined in the compressor. The first drive-shaft-parallel line segment A and the second drive-shaft-parallel line segment each corresponds to a drive-shaft-parallel line segment. The first drive-shaft-parallel line segment A contains the first acting position F1 and connects the proximal end 502 of the movable body weight 134 and the proximal end 501 of the swash plate weight 5*c*. That is, the first drive-shaft-parallel line segment A connects the rear end face 132*c* of the second cylindrical portion 132 and the front surface 5*a* of the swash plate main portion 50 to each other, while extending in parallel with the drive shaft axis O. The intersection of the first drive-shaft-parallel line segment A and the proximal end 501 of the swash plate weight 5*c* is defined as a first intersection C1. Also, the intersection of the first drive-shaft-parallel line segment A and the proximal end 502 of the movable body weight 134 is defined as a second intersection C2. The second drive-shaft-parallel line segment is similar to the first drive-shaft-parallel line segment A and is located on the opposite side of the drive shaft axis O from the first drive-shaft-parallel line segment A. The second drive-shaft-parallel line segment contains the second acting position F2 and connects the proximal end 502 of the movable body weight 134 and the proximal end 501 of the swash plate weight 5*c*, while extending in parallel with the drive shaft axis O.

In the compressor having the above-described configuration, the drive shaft 3 rotates to rotate the swash plate 5, thus reciprocating each piston 9 in the corresponding cylinder bore 21*a*. This varies the volume of each compression chamber 57 in accordance with the piston stroke. Thus, the refrigerant that has been drawn from the evaporator into the swash plate chamber 25 through the inlet 250 flows through the suction passage 39 and the suction chamber 33 and is compressed in the compression chambers 57. The refrigerant that is compressed in the compression chambers 57 is discharged to the discharge chamber 35 and is discharged to the condenser through the outlet.

The actuator 13 changes the inclination angle of the swash plate 5 to increase or decrease the stroke of the pistons 9, thereby varying the displacement of the compressor.

Specifically, when the control valve 15*c* of the control mechanism 15 shown in FIG. 2 reduces the opening degree of the low-pressure passage 15*a*, the pressure in the pressure regulation chamber 31 is increased, and the pressure in the control pressure chamber 13*b* is increased. This causes the movable body 13*a* to move along the drive shaft axis O toward the swash plate 5 as shown in FIGS. 9 and 10, while moving away from the lug plate 51.

When the movable body 13*a* is separated away from the lug plate 51, the movable body distance L has a length L2 shown in FIG. 9, which is longer than a length L1 of the movable body distance L shown in FIG. 8, which corresponds to the maximum inclination angle of the swash plate 5.

When the movable body 13*a* is separated away from the lug plate 51, the first acting portion 14*a* shown in FIG. 7 pushes, at the first acting position F1, the first protrusion 5*g* of the swash plate weight 5*c* shown in FIG. 3 toward the rear of the swash plate chamber 25. Thus, the first acting position F1 moves on the first inclined surface 134*a* toward the first vertical surface 134*c*. Likewise, the second acting portion 14*b* shown in FIG. 7 pushes, at the second acting position F2, the second protrusion 5*h* of the swash plate weight 5*c* shown in FIG. 3 toward the rear of the swash plate chamber 25 along the drive shaft axis O. Thus, the second acting position F2 also moves on the second inclined surface 134*b* toward the second vertical surface 134*d*. Accordingly, the swash plate 5 is moved rearward in the swash plate chamber 25 along the drive shaft axis O, so that the swash plate distance X becomes a length X2, which is longer than a length X1 of the swash plate distance X shown in FIG. 8, which corresponds to the maximum inclination angle of the swash plate 5.

As described above, the first and second acting positions F1, F2 are located at positions shifted closer to the bottom dead center associated part U than the drive shaft axis O. That is, the first and second acting positions F1, F2 are located between the drive shaft axis O and the bottom dead center associated part U. Thus, the movable body 13*a* pushes the swash plate 5 at a position shifted closer to the bottom dead center associated part U than the drive shaft axis O via the first and second acting portions 14*a*, 14*b* and the first and second protrusions 5*g*, 5*h*. Therefore, the first and second swash plate arms 5*e*, 5*f* slide on the first and second guide surfaces 57*a*, 57*b*, respectively, toward the drive shaft axis O as shown in FIG. 10.

Thus, as shown in FIG. 9, the swash plate 5 decreases the inclination angle while substantially maintaining the position of the top dead center associated part T. This reduces the stroke of the pistons 9 and the displacement of the compressor per rotation of the drive shaft 3.

When the pressure in the pressure regulation chamber 31 is further increased, so that the movable body 13*a* is separated further away from the lug plate 51 as shown in FIG. 10, the movable body distance L becomes a length L3, which is longer than the length L1 and the length L2. Accordingly, the swash plate distance X becomes a length X3, which is longer than the length X1 and the length X2. This reduces the inclination angle of the swash plate 5 to the minimum inclination angle. When reaching the minimum inclination angle, the swash plate 5 contacts the restoration spring 37.

In contrast, when the control valve 15*c* of the control mechanism 15 shown in FIG. 2 increases the opening degree of the low-pressure passage 15*a*, the pressure in the pressure regulation chamber 31 and thus the pressure in the control pressure chamber 13*b* become substantially equal to the pressure in the suction chamber 33. Thus, reaction force that acts on the swash plate 5 from components such as the pistons 9 causes the movable body 13*a* to move along the drive shaft axis O from the swash plate 5 toward the lug plate 51 as shown in FIG. 8. This causes the movable body 13*a* to move deeply into the cylinder chamber 51*a*. This gradually shortens the movable body distance L from the length L3. When the swash plate 5 reaches the minimum inclination angle, the movable body distance L becomes the length L1.

The reaction force acting on the swash plate 5 and the urging force of the restoration spring 37 cause the first and second swash plate arms 5*e*, 5*f* to slide on the first and second guide surfaces 57*a*, 57*b*, respectively, to move away from the drive shaft axis O.

The swash plate 5 thus increases the inclination angle while substantially maintaining the position of the top dead center associated part T. This increases the stroke of the pistons 9 and thus increases the displacement of the compressor per rotation of the drive shaft 3. As the inclination angle is increased, the swash plate distance X is gradually reduced from the length X3. When the swash plate 5 reaches the maximum inclination angle, the swash plate distance X becomes the length X1.

In this manner, when the movable body 13*a* moves from the swash plate 5 toward the lug plate 51 so that the movable body distance L and the swash plate distance X are shortened, the swash plate 5 is increased. At this time, as the inclination angle of the swash plate 5 is increased, the first drive-shaft-parallel line segment A is shortened. That is, the first drive-shaft-parallel line segment A is shorter when the inclination angle of the swash plate 5 is maximized than when the inclination angle is minimized. The same applies to the second drive-shaft-parallel line segment. Thus, the stroke of the movable body 13*a* required for changing the inclination angle of the swash plate 5 is shortened in this compressor, which reduces the axial length. This function of the compressor of the present embodiment will be described below by comparing the same with the compressor disclosed in Japanese Laid-Open Patent Publication No. 52-131204.

Figure 11:
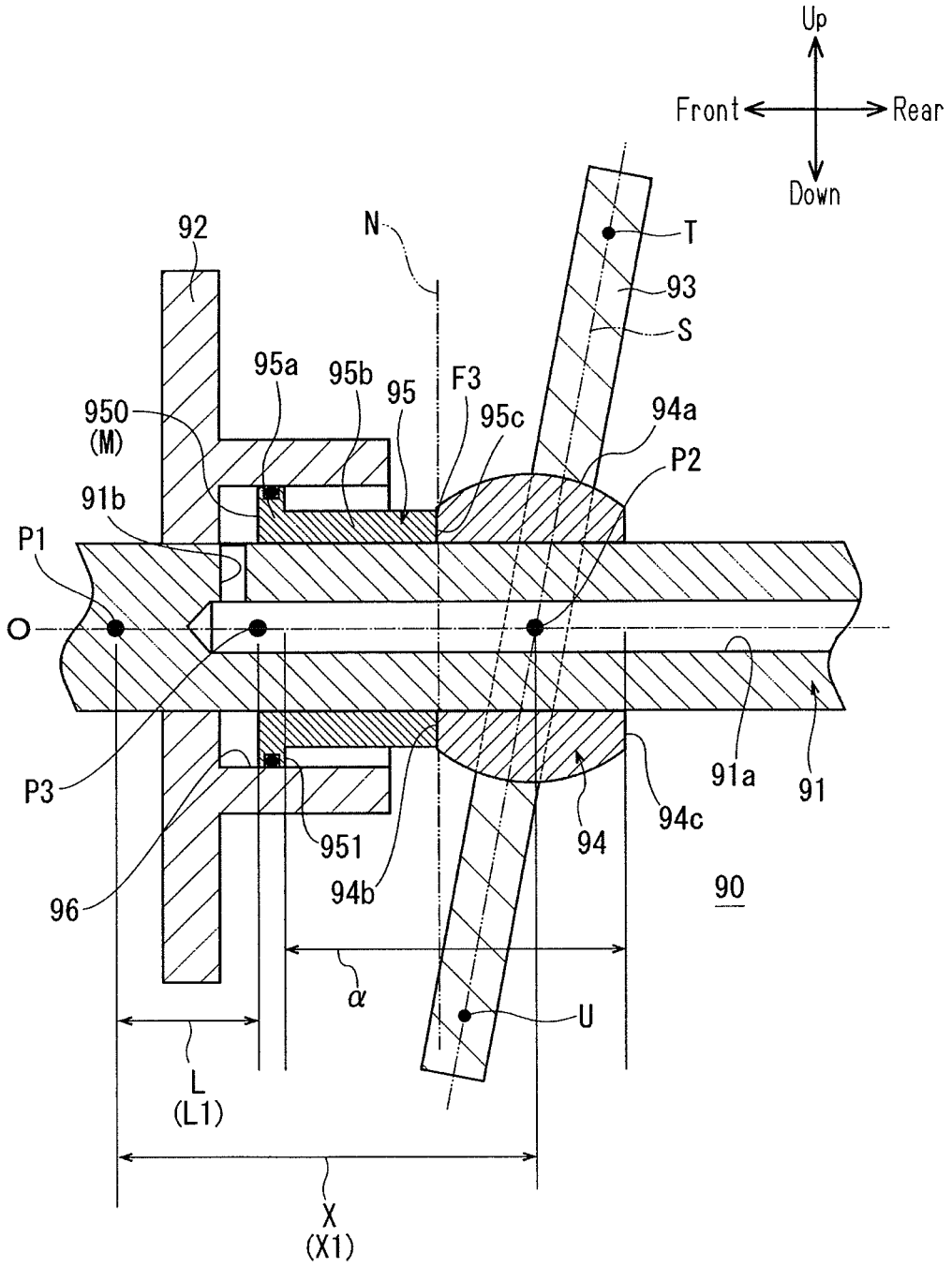
FIG. 11 is a schematic enlarged partial cross-sectional view of a drive-shaft-parallel line segment when the displacement is maximized in a compressor of a comparative example.
Figure 12:
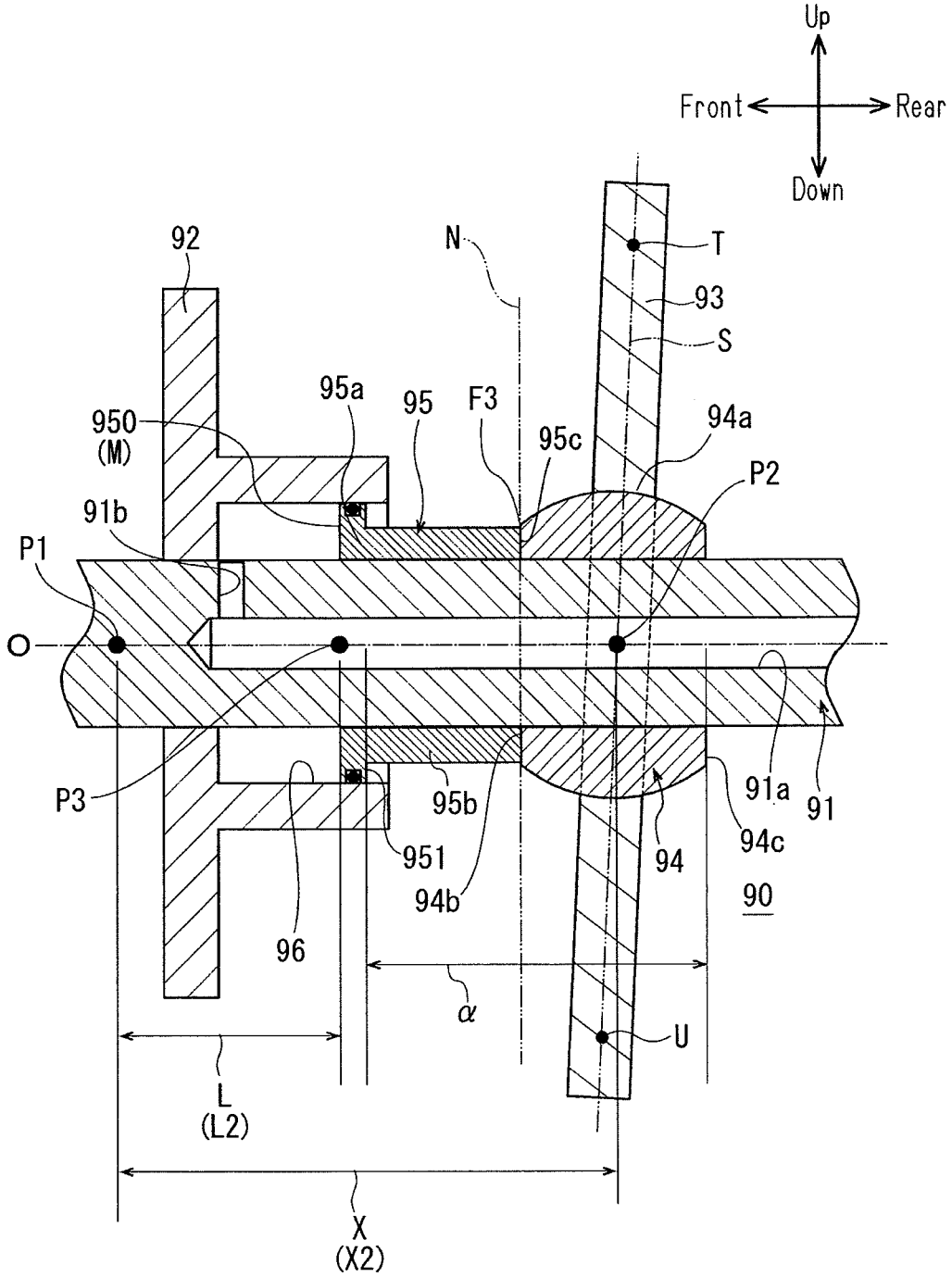
FIG. 12 is a schematic enlarged partial cross-sectional view of the drive-shaft-parallel line segment when the displacement is minimized in the compressor of the comparative example.

As shown in FIGS. 11 and 12, the compressor of the comparison example includes a drive shaft 91, a lug member 92, a swash plate 93, a hinge ball 94, a movable body 95, and a control pressure chamber 96. These components, which include the lug member 92, are arranged in a swash plate chamber 90. The drive shaft 91 has a shaft hole 91*a* and a radial hole 91*b*. The hinge ball 94 includes a spherical portion 94*a*, which slides on the swash plate 5, a receiving portion 94*b*, which is located on the side corresponding to the movable body 95, and a rear end 94*c*, which is located on the side opposite to the movable body 95. The receiving portion 94*b* and the rear end 94*c* are both formed as a flat surface perpendicular to the drive shaft axis O.

The movable body 95 includes a large diameter portion 95*a* and a small diameter portion 95*b*. The large diameter portion 95*a* includes a front end face 950 and a rear end face 951. The small diameter portion 95*b* extends toward the hinge ball 94 from a proximal end, which is part of the rear end face 951 of the large diameter portion 95*a*. The surface of the small diameter portion 95*b* that faces the hinge ball 94 is an acting portion 95*c*. The front end face 950, the rear end face 951, and the acting portion 95*c* are all flat surfaces perpendicular to the drive shaft axis O. The acting portion 95*c* and the receiving portion 94*b* of the hinge ball 94 make surface contact with each other at an acting position F3. The hinge ball 94 and the movable body 95 are fitted about the drive shaft 91, and the acting portion 95*c* and the receiving portion 94*b* are flat surfaces. Thus, the acting position F3 is located about the drive shaft 91. For illustrative purposes, the shapes of the components such as the lug member 92 are simplified in FIGS. 11 and 12, and the link that connects the lug member 92 to the swash plate 93 is omitted.

In the compressor of the comparison example also, a reference point P1 is defined on the drive shaft axis O. Also, a swash plate reference plane Sand a swash plate intersection P2 are defined in the swash plate 93. The front end face 950 of the large diameter portion 95*a* is defined as a movable body reference plane M, and a movable body intersection P3 is defined. Further, an acting plane N, a movable body distance L, and a swash plate distance X are defined. In addition, a drive-shaft-parallel line segment a is defined that contains the acting position F3 and connects the rear end 94*c* of the hinge ball 94 to a part of the rear end face 951 of the large diameter portion 95*a*, which is the proximal end of the small diameter portion 95*b*, while extending in parallel with the drive shaft axis O.

In the compressor of the comparison example, the when movable body 95 is moved toward the swash plate 93 along the drive shaft axis O, so that the movable body distance L is extended from a length L1 shown in FIG. 11 to a length L2 shown in FIG. 12, the acting position F3 is moved rearward along the drive shaft axis O by an amount corresponding to the extended amount. The hinge ball 94 is pushed rearward by the movable body 95 along the drive shaft axis O in the swash plate chamber 90, so that the swash plate 5 is moved rearward in the swash plate chamber 90 along the drive shaft axis O. Accordingly, the swash plate distance X is extended from a length X1 shown in FIG. 11 to a length X2 shown in FIG. 12. This reduces the inclination angle of the swash plate 93.

In the compressor of the comparison example, when the swash plate 93 is changed from the maximum inclination angle shown in FIG. 11 to the minimum inclination angle shown in FIG. 12, the drive-shaft-parallel line segment a remains constant without being changed. The same applies to the case in which the swash plate 93 is changed from the maximum inclination angle to the minimum inclination angle. Thus, the swash plate distance X is extended by an amount corresponding to the extended amount of the movable body distance L, so that the inclination angle is reduced. In other words, the swash plate distance X is shortened by an amount corresponding to the shortened amount of the movable body distance L, so that the inclination angle is increased. Therefore, in the compressor of the comparison example, the stroke of the movable body 95 required for changing the inclination angle is great, and the axial length needs to be increased to ensure the space for the stroke.

In contrast, in the compressor of the first embodiment, the first acting position F1 is moved from the first vertical surface 134*c* toward the first inclined surface 134*a* as the inclination angle of the swash plate 5 increases. That is, the first acting position F1 is moved along the first inclined surface 134*a* toward the proximal end 502 of the movable body weight 134 as the inclination angle of the swash plate 5 increases, so that the first acting position F1 is moved from the swash plate 5 toward the lug plate 51 along the drive shaft axis O. As in the case of the first acting position F1, the second acting position F2 is moved along the second inclined surface 134*b* toward the proximal end 502 of the movable body weight 134, thereby moving from the swash plate 5 toward the lug plate 51 along the drive shaft axis O. Accordingly, in the compressor of the first embodiment, when the inclination angle of the swash plate 5 is increased from the minimum inclination angle, the first drive-shaft-parallel line segment A is shortened from a length A3 shown in FIG. 10 to a length A2 shown in FIG. 9. When the inclination angle of the swash plate 5 is further increased to the maximum inclination angle, the first drive-shaft-parallel line segment A is shortened to a length A1 as shown in FIG. 8. The second drive-shaft-parallel line segment is changed in the similar manner to the first drive-shaft-parallel line segment A.

In this manner, the first drive-shaft-parallel line segment A and the second drive-shaft-parallel line segment of the compressor of the first embodiment are shorter when the inclination angle of the swash plate 5 is maximized than when it is minimized. Thus, in the compressor of the first embodiment, the stroke of the movable body 13*a* required for changing the inclination angle of the swash plate 5 is reduced by an amount corresponding to the shortened amount of the first drive-shaft-parallel line segment A and the second drive-shaft-parallel line segment. This shortens the axial length of the compressor.

Figure 13:
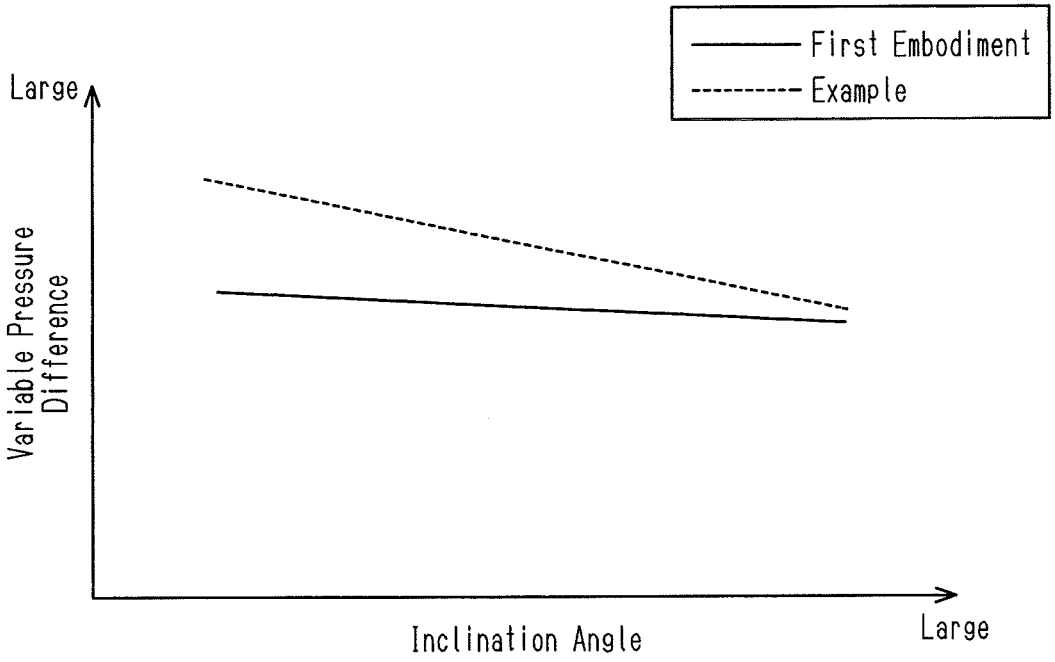
FIG. 13 is a graph showing the relationship between the inclination angle and the variable pressure difference.

Also, as shown in FIGS. 11, 12, the acting position F3 is located about the drive shaft 3 in the compressor of the comparison example. During operation of the compressor, each piston 9 applies reaction force to the swash plate 93. The reaction force is great at positions in the swash plate main portion 50 that are closer to the top dead center associated part T than the drive shaft axis O. Thus, in the compressor of the comparison example, in which the acting position F3 is located about the drive shaft 3, the acting position F3 is located close to the top dead center associated part T, and the movable body 95 is easily influenced by the reaction force. Therefore, as indicated by the graph of FIG. 13, in the compressor of the comparative example, the pressure difference between the swash plate chamber 90 and the control pressure chamber 96 (hereinafter, referred to as a variable pressure difference) needs to be increased to move the movable body 95 with a greater thrust as the inclination angle of the swash plate 93 is reduced.

Further, if the compressor of the comparison example has a small displacement per rotation of the drive shaft 91 and the pressure in the control pressure chamber 96 cannot be increased, the variable pressure difference cannot be increased. Thus, to move the movable body 95 with a great thrust, the size of the movable body 95 may be increased to enlarge the pressure receiving area.

In contrast, in the compressor according to the first embodiment, not only when the swash plate 5 is at the minimum inclination angle, but also at the maximum inclination angle, the first and second acting positions F1, F2 are located at positions shifted closer to the bottom dead center associated part U than the drive shaft axis O. Thus, the first and second acting positions F1, F2 are separated away from the top dead center associated part T, which makes the movable body 13*a* less prone to influence of the reaction force. That is, the load on the movable body 13*a* when decreasing the inclination angle of the swash plate 5 is reduced, so that the movable body 13*a* is moved without increasing the variable pressure difference. Accordingly, in the compressor according to the first embodiment, the variable pressure difference is reduced over the entire range and made substantially constant as indicated by the graph of FIG. 11 when the inclination angle is changed.

As described above, in the compressor according to the first embodiment, the movable body 13*a* is moved without increasing the variable pressure difference. Thus, even if the displacement per rotation of the drive shaft is small, the movable body 13*a* is moved reliably. Thus, the movable body 13*a* does not need to be increased in size.

In the compressor of the comparative example, since the acting position F3 is located about the drive shaft 3, the distance between the acting position F3 and the drive shaft axis O is constant even if the inclination angle of the swash plate 93 is changed. In contrast, in the compressor of the first embodiment, when the swash plate 5 is at the minimum inclination angle as shown in FIG. 10, the first vertical surface 134*c* and the first protrusion 5*g* of the swash plate weight 5*c* make line contact at the first acting position F1. Likewise, the second vertical surface 134*d* and the second protrusion 5*h* of the swash plate weight 5*c* make line contact at the second acting position F2.

When the inclination angle of the swash plate 5 is slightly increased as shown in FIG. 9, the first inclined surface 134*a* and the first protrusion 5*g* of the swash plate weight 5*c* make line contact at the first acting position F1. More specifically, a part of the first inclined surface 134*a* that is relatively close to the first vertical surface 134*c* and the first protrusion 5*g* make line contact. When the inclination angle of the swash plate 5 is maximized as shown in FIG. 8, a part of the first inclined surface 134*a* that is relatively close to the second cylindrical portion 132 and the first protrusion 5*g* make line contact at the first acting position F1.

As described above, in the compressor of the first embodiment, as the inclination angle of the swash plate 5 is increased, the first acting position F1 is moved toward the lug plate 51 along the drive shaft axis O and from the bottom dead center associated part U toward the drive shaft axis O. The second acting position F2 is moved in the similar manner to the first acting position F1. Thus, when the inclination angle is increased within the same range of the inclination angle of the swash plate 5, the stroke of the movable body 13*a* along the drive shaft axis O is smaller in the compressor according to the first embodiment than in the compressor of the comparison example, in which the distance between the acting position and the drive shaft axis O is constant even if the inclination angle is changed. This configuration also allows the axial length of the compressor of the first embodiment to be shortened.

Therefore, the compressor of the first embodiment is reduced in size.

Further, the reaction force that acts from the pistons 9 to the swash plate 5 during operation of the compressor generates moment that acts to rotate the swash plate 5 in a direction other than the direction in which the inclination angle is changed. This creates a warp in the swash plate 5. In this respect, the guide surfaces 52*a*, 52*b* in the through hole 5*d* of the compressor slide on the outer circumferential surface 30 of the drive shaft 3 in response to changes in the inclination angle of the swash plate 5. Then, the swash plate 5 is guided by the link mechanism 7 and the drive shaft 3 along the drive shaft axis O and in the direction of the inclination angle, so that the inclination angle is changed as described above. At this time, the guide surfaces 52*a*, 52*b* allow the swash plate 5 to easily contact the outer circumferential surface 30 of the drive shaft 3 at two points on opposite sides of the drive shaft axis O. Therefore, the compressor reliably prevents the swash plate 5 from being warped by the moment. Since the compressor has no sleeve, the number of components is reduced, and the manufacturing costs are reduced, accordingly.

Further, the movable body weight 134 has the first and second inclined surfaces 134*a*, 134*b* and the first and second vertical surfaces 134*c*, 134*d*, and the swash plate weight 5*c* has the first and second protrusions 5*g*, 5*h*. As the inclination angle of the swash plate 5 is changed, the first protrusion 5*g* from the first inclined surface 134*a* to the first vertical surface 134*c*, the second protrusion 5*h* is moved from the second inclined surface 134*b* to the second vertical surface 134*d*. Accordingly, the first and second acting positions F1, F2 are moved in the above described manner. That is, to make the first and second drive-shaft-parallel line segments A shorter when the inclination angle of the swash plate 5 is maximized than when it is minimized, the shapes of the first and second inclined surfaces 134*a*, 134*b*, the first and second vertical surfaces 134*c*, 134*d*, and the first and second protrusions 5*g*, 5*h* each function as a profile. The compressor thus reliably realizes the above described function, while simplifying the structures of the swash plate weight 5*c* and the movable body weight 134.

Also, the movable body 13*a* includes the movable body weight 134, and the swash plate 5 includes the swash plate weight 5*c*. Therefore, when rotation of the drive shaft 3 rotates the link mechanism 7, the actuator 13, and the swash plate 5, the balance is regulated reliably. Therefore, rotation of the drive shaft 3 reliably rotates the link mechanism 7, the actuator 13, and the swash plate 5, and vibration during operation of the compressor is suppressed.

Further, the movable body weight 134 functions as the first and second acting portions 14*a*, 14*b*, and the swash plate weigh 5*c* functions as a receiving portion. Therefore, an acting portion is easily provided in the movable body 13*a*, and a receiving portion is easily provided in the swash plate 5.

Second Embodiment

Figure 14:
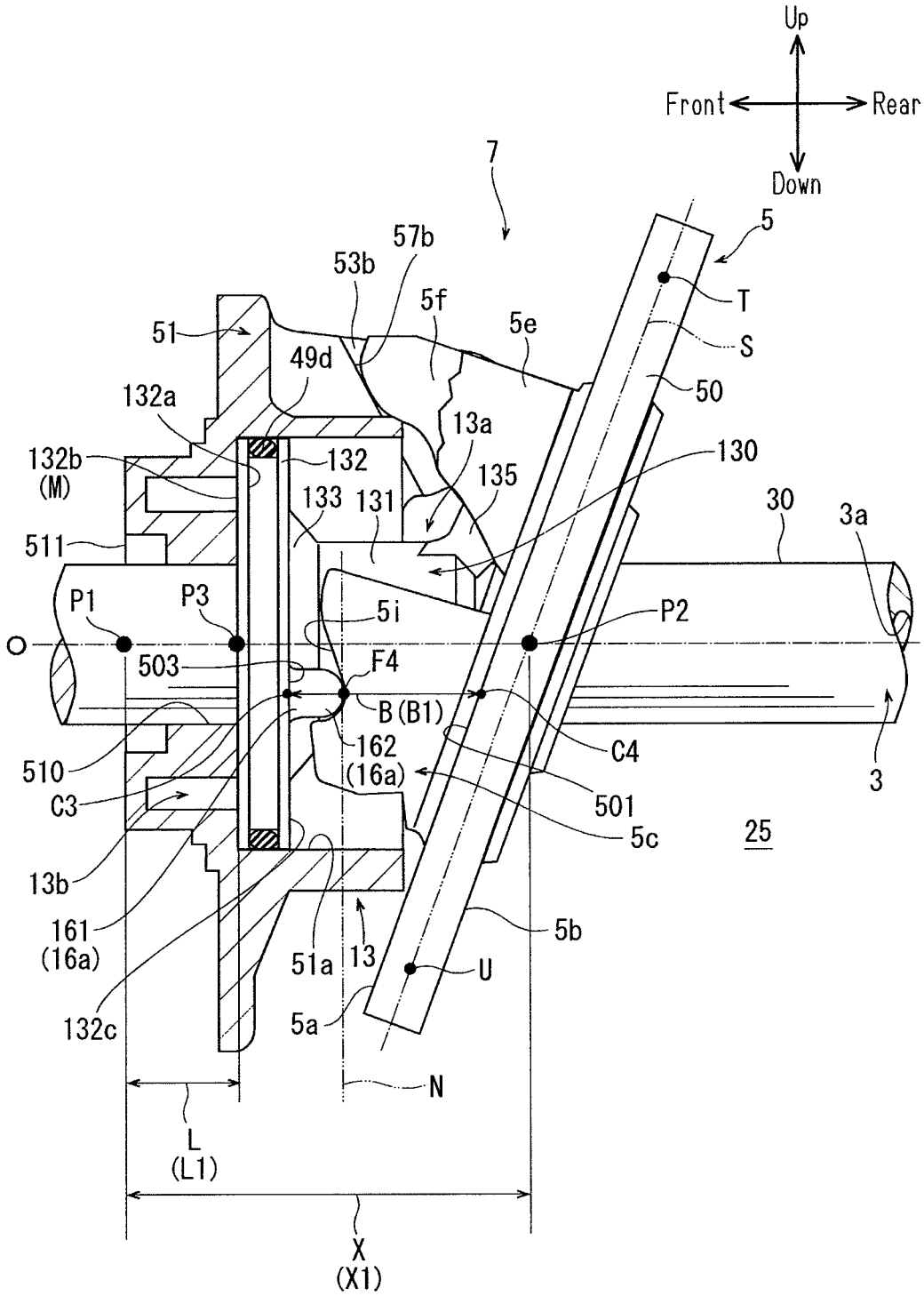
FIG. 14 is an enlarged partial cross-sectional view of a first drive-shaft-parallel line segment when the displacement is maximized in a compressor according to a second embodiment.
Figure 15:
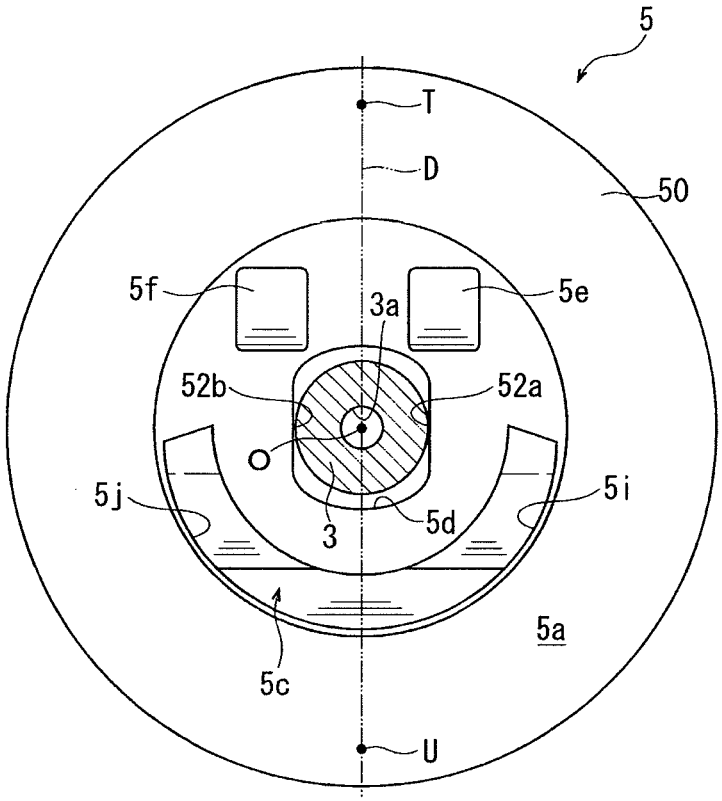
FIG. 15 is a schematic front view of the swash plate of a compressor according to the second embodiment.

As shown in FIGS. 14, 15, the swash plate weight 5*c* of the compressor according to the second embodiment has first and second accommodating sections 5*i*, 5*j*. As shown in FIG. 15, the first and second accommodating sections 5*i*, 5*j* are arranged on the swash plate weight 5*c* at positions on opposite sides of the imaginary plane D. The accommodating sections 5*i*, 5*j* are located at positions closer to the bottom dead center associated part U than the drive shaft axis O. That is, the first and second accommodating sections 5*i*, 5*j* are located between the drive shaft axis O and the bottom dead center associated part U.

As shown in FIG. 14, the first accommodating section 5*i* is curved and recessed from the front face of the swash plate weight 5*c* toward the proximal end 501 of the swash plate weight 5*c* such that the depth of the recess increases from the drive shaft axis O toward the bottom dead center associated part U. The second accommodating section 5*j*, which is shown in FIG. 15, has the same shape as the first accommodating section 5*i*. For illustrative purposes, the shapes of the swash plate weight 5*c* and the first and second swash plate arms 5*e*, 5*f*, as well as the shapes of the first and second accommodating sections 5*i*, 5*j*, are simplified in FIG. 15.

Figure 16:
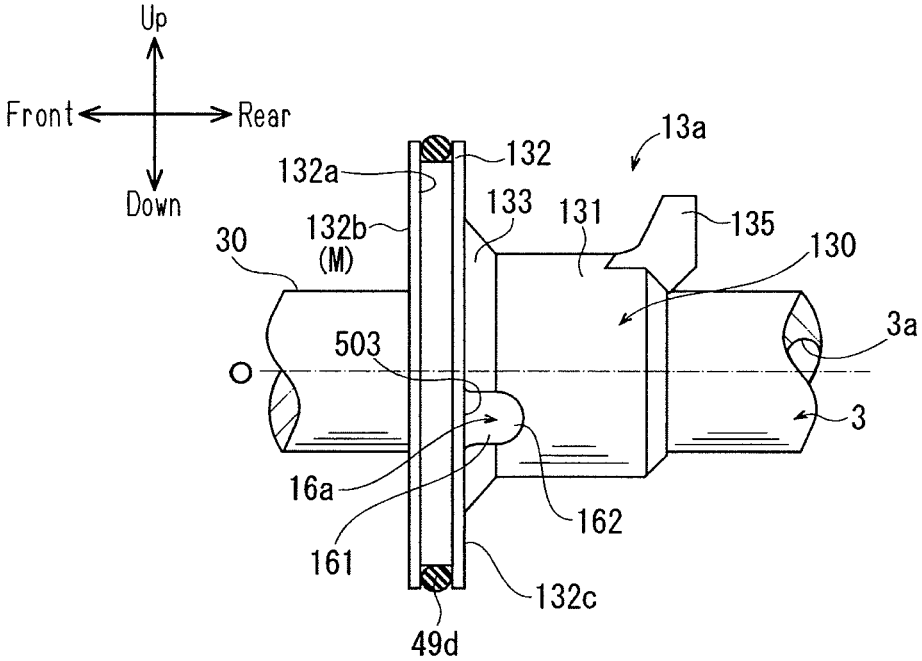
FIG. 16 is a side view of the movable body of the compressor according to the second embodiment.
Figure 17:
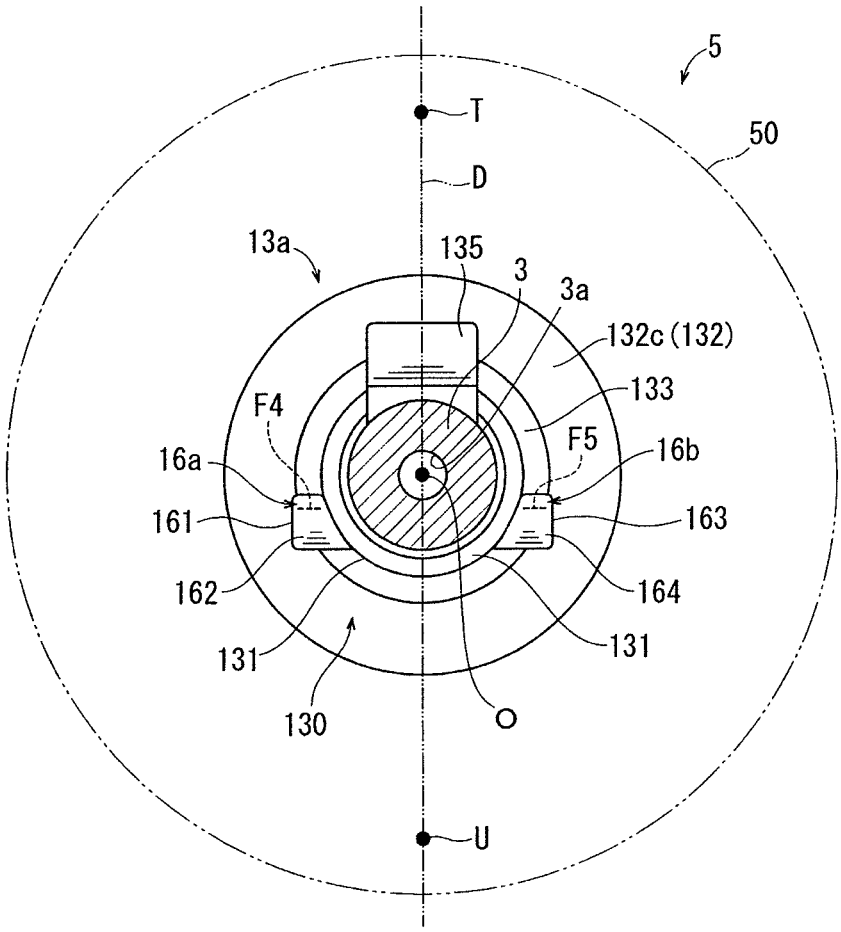
FIG. 17 is a rear view of the movable body of the compressor according to the second embodiment.

As shown in FIGS. 16, 17, the movable body 13*a* of this compressor includes first and second acting portions 16*a*, 16*b* in place of the movable body weight 134. The first and second acting portions 16*a*, 16*b* each correspond to an acting portion. As shown in FIG. 17, the first and second acting portions 16*a*, 16*b* are arranged on the movable body 13*a* at positions on opposite sides of the imaginary plane D. The first and second acting portions 16*a*, 16*b* are located at positions closer to the bottom dead center associated part U than the drive shaft axis O. That is, the first and second acting portions 16*a*, 16*b* are located between the drive shaft axis O and the bottom dead center associated part U.

As shown in FIG. 16, the first acting portion 16*a* includes a shaft portion 161 and a distal portion 162. The shaft portion 161 of the first acting portion 16*a* extends along the drive shaft axis O toward the swash plate 5 from a proximal end 503, which is a part of the rear end face 132*c* of the second cylindrical portion 132. The distal portion 162 is continuous with the distal end of the shaft portion 161 and has a cylindrical shape with a generatrix extending in a direction perpendicular to the imaginary plane D. Like the first acting portion 16*a*, the second acting portion 16*b* shown in FIG. 17 has a shaft portion 163 and a distal portion 164. The structures of the shaft portion 163 and the distal portion 164 are the same as those of the shaft portion 161 and the distal portion 162.

The distal portion 162 of the first acting portion 16*a* and the distal portion of the swash plate weight 5*c* contact each other at a first acting position F4 shown in FIG. 17. Since the distal portion 162 has a cylindrical shape as described above, the distal portion 162, that is, the first acting portion 16*a* makes line contact with the swash plate weight 5*c* at the first acting position F4. Likewise, the second acting portion 16*b* and the distal portion of the swash plate weight 5*c* make line contact at a second acting position F5 shown in FIG. 17. When the inclination angle of the swash plate 5 is changed, the first and second acting portions 16*a*, 16*b* slide from the distal portion of the swash plate weight 5*c* to the first and second accommodating sections 5*i*, 5*j*.

In this compressor also, the swash plate weight 5*c* and the first and second acting portions 16*a*, 16*b* are located at positions closer to the bottom dead center associated part U than the drive shaft axis O. Thus, not only when the swash plate 5 is at the minimum inclination angle shown in FIG. 19, but also when at the maximum inclination angle shown in FIG. 14, the first and second acting positions F4, F5 are located at positions shifted closer to the bottom dead center associated part U than the drive shaft axis O.

As in the compressor of the first embodiment, a reference point P1 is defined on the drive shaft axis O in the drive shaft 3. Also, a swash plate reference plane S and a swash plate intersection P2 are defined in the swash plate 5. Further, a movable body reference plane M and a movable body intersection P3 are defined in the movable body 13*a*.

Also, an acting plane N is defined that contains the first and second acting positions F4, F5 and is perpendicular to the drive shaft axis O. Further, a movable body distance L and a swash plate distance X are defined.

A first drive-shaft-parallel line segment B and a second drive-shaft-parallel line segment (not shown) are defined also in this compressor. The first drive-shaft-parallel line segment B contains the first acting position F4 and connects the proximal end 501 of the swash plate weight 5*c* and the proximal end 503 of the shaft portion 161. That is, first drive-shaft-parallel line segment B connects the rear end face 132*c* of the second cylindrical portion 132, which is the proximal end 503 of the first acting portion 16*a*, and the proximal end 501 of the swash plate weight 5*c*, while extending in parallel with the drive shaft axis O. The intersection of the first drive-shaft-parallel line segment B and the proximal end 501 of the swash plate weight 5*c* is defined as a first intersection C3. Also, the intersection of the first drive-shaft-parallel line segment B and the proximal end 503 of the first acting portion 16*a* is defined as a second intersection C4. The second drive-shaft-parallel line segment is similar to the first drive-shaft-parallel line segment B and is located on the opposite side of the drive shaft axis O from the first drive-shaft-parallel line segment B. The second drive-shaft-parallel line segment contains the second acting position F5 and connects the proximal end 503 of the second acting portion 16*b* and the proximal end 501 of the swash plate weight 5*c*, while extending in parallel with the drive shaft axis O. The other components of the compressor of the second embodiment are configured identically with the corresponding components of the compressor of the first embodiment. Accordingly, these components are identified by the same reference numbers, and detailed description thereof is omitted herein.

In this compressor also, when the inclination angle of the swash plate 5 is reduced, the movable body 13*a* is moved from the lug plate 51 toward the swash plate 5 along the drive shaft axis O. Accordingly, the movable body distance L is extended from a length L1 shown in FIG. 14 to a length L2 shown in FIG. 18 and further to a length L3 shown in FIG. 19. The first acting portion 16*a* pushes, at the first acting position F4, the distal portion of the swash plate weight 5*c* toward the rear of the swash plate chamber 25, and the second acting portion 16*b* shown in FIG. 17 pushes, at the second acting position F5, the distal end of the swash plate weight 5*c* toward the rear of the swash plate chamber 25. This moves the swash plate 5 rearward in the swash plate chamber 25 along the drive shaft axis O, so that the swash plate distance X is extended from a length X1 shown in FIG. 14 to a length X2 shown in FIG. 18 and further to a length X3 shown in FIG. 19.

As the inclination angle of the swash plate 5 decreases, the first acting portion 16*a* slides along the distal portion of the swash plate weight 5*c* from a position close to the bottom dead center associated part U to a position close to the drive shaft axis O. In contrast, as the inclination angle of the swash plate 5 increases, the first acting portion 16*a* gradually enters the first accommodating section 5*i* and is eventually accommodated in the first accommodating section 5*i*. As described above, the first accommodating section 5*i* is curved and recessed from the front face of the swash plate weight 5*c* toward the proximal end 501 of the swash plate weight 5*c* such that the depth of the recess increases from a position close to the drive shaft axis O toward a position close to the bottom dead center associated part U. Thus, when the swash plate 5 is at the maximum inclination angle as shown in FIG. 14, the distal portion 162 of the first acting portion 16*a* makes line contact with the swash plate weight 5*c* at a position in the first accommodating section 5*i* that is close to the proximal end 501 of the swash plate weight 5*c*, that is, while being accommodated at the most recessed position in the first accommodating section 5*i*. When the distal portion 162 of the first acting portion 16*a* is accommodated in the first accommodating section 5*i* as described above, the first acting position F4 moves toward the swash plate 5 along the drive shaft axis O. The second acting position F5 is moved in the similar manner to the first acting position F4. Therefore, as shown in FIG. 14, the first drive-shaft-parallel line segment B has a length B1 when the swash plate 5 is at the maximum inclination angle.

Figure 18:
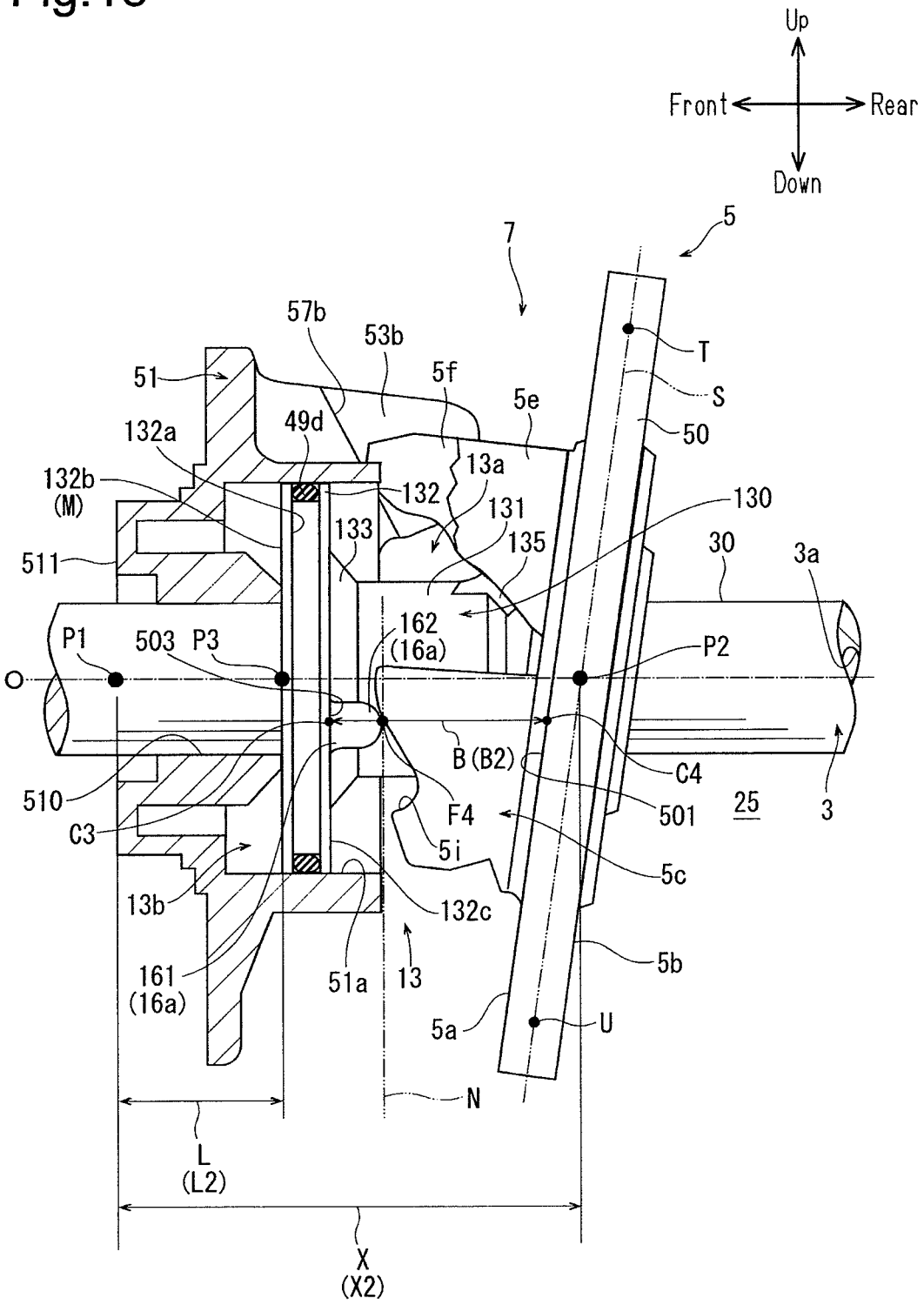
FIG. 18 is an enlarged partial cross-sectional view of the first drive-shaft-parallel line segment when the displacement is decreased from the maximum displacement in the compressor according to the second embodiment.
Figure 19:
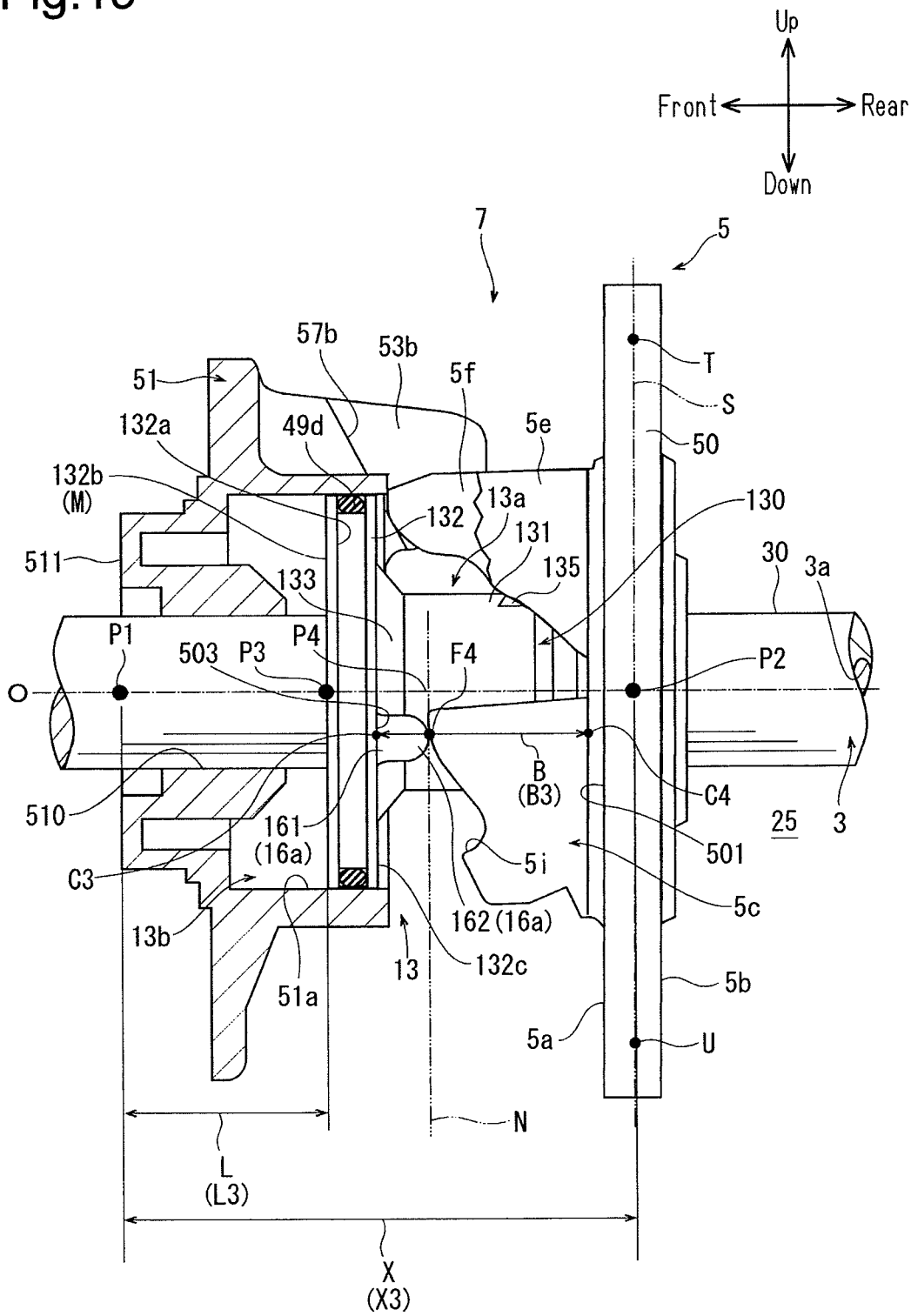
FIG. 19 is an enlarged partial cross-sectional view of a first drive-shaft-parallel line segment when the displacement is minimized in the compressor according to the second embodiment.

When the inclination angle of the swash plate 5 is slightly reduced as shown in FIG. 18, the first acting portion 16*a* slides on the first accommodating section 5*i* to a position slightly closer to the drive shaft axis O. Thus, the distal portion 162 of the first acting portion 16*a* makes line contact with the swash plate weight 5*c* at a position in the first accommodating section 5*i* that is closer to the drive shaft axis O, that is, at a shallower position than when the swash plate 5 is at the maximum inclination angle. Thus, the first acting position F4 is moved along the drive shaft axis O toward the movable body 13*a*. This extends the first drive-shaft-parallel line segment B to a length B2, which is longer than the length B1. Further, when the inclination angle of the swash plate 5 is minimized as shown in FIG. 19, the distal portion 162 of the first acting portion 16*a* exits the first accommodating section 5*i* and slides to a position close to the drive shaft axis O. Thus, the first acting position F4 is moved along the drive shaft axis O further toward the movable body 13*a*. This extends the first drive-shaft-parallel line segment B to a length B3, which is longer than the lengths B1 and B2. The second drive-shaft-parallel line segment is changed in the similar manner to the first drive-shaft-parallel line segment B.

In this manner, the first drive-shaft-parallel line segment B of this compressor is also shorter when the inclination angle of the swash plate 5 is maximized than when the inclination angle is minimized. In this compressor, the movable body 13*a* has the first and second acting portions 16*a*, 16*b*, which extend toward the swash plate 5, and the swash plate weight 5*c* has the first and second accommodating sections 5*i*, 5*j*. As the inclination angle of the swash plate 5 is increased, the distal portion 162 of the first acting portion 16*a* is accommodated at a deep position in the first accommodating section 5*i*, and the distal portion 164 of the second acting portion 16*b* is accommodated at a deep position in the second accommodating section 5*j*, so that the first and second acting positions F4, F5 are moved in the above described manner. That is, to make the first and second drive-shaft-parallel line segments B shorter when the inclination angle of the swash plate 5 is maximized than when it is minimized, the shapes of the first and second acting portions 16*a*, 16*b* and the first and second accommodating sections 5*i*, 5*j* each function as a profile. The above described function is reliably realized, while simplifying the structures of the swash plate weight 5*c* and the movable body 13*a*. Even if the inclination angle of the swash plate 5 is increased, the first and second acting positions F4, F5 are not moved from the bottom dead center associated part U toward the drive shaft axis O. The other operations of the compressor are the same as the corresponding operations of the compressor of the first embodiment.

Although only the first and second embodiments of the present invention have been described so far, the present invention is not limited to the first and second embodiments, but may be modified as necessary without departing from the scope of the invention.

For example, the reference point 51 may be defined at another position on the drive shaft axis O. The rear end face 132*c* of the second cylindrical portion 132 may be defined as the movable body reference plane M.

The compressor according to the first embodiment may be configured such that, while the inclination angle of the swash plate 5 is increased from the minimum inclination angle to a predetermined inclination angle, the first and second acting positions F1, F2 are moved in a direction from the bottom dead center associated part U toward the drive shaft axis O, and while the inclination angle of the swash plate 5 is increased from the predetermined inclination angle to the maximum inclination angle, the first and second acting positions F1, F2 do not move.

In the compressor according to the first embodiment, the first and second acting portions 14*a*, 14*b* and the first and second protrusions 5*g*, 5*h* may be configured to make point contact. The same modification may be applied to the compressor according to the second embodiment.

The movable body weight 134 of the compressor according to the first embodiment may be configured such that the first and second acting portions 14*a*, 14*b* protrude further toward the swash plate 5 than the first cylindrical portion 131. Likewise, the compressor according to the second embodiment may be configured such that the first and second acting portions 16*a*, 16*b* protrude further toward the swash plate 5 than the first cylindrical portion 131.

In the compressor according to the first embodiment, the swash plate weight 5*c* may have only one of the first and second protrusions 5*g*, 5*h*. Likewise, in the compressor according to the second embodiment, the swash plate weight 5*c* may have only one of the first and second accommodating sections 5*i*, 5*j*, and the movable body 13*a* may have only one of the first and second acting portions 16*a*, 16*b* that corresponds to the selected one of the first and second accommodating sections 5*i*, 5*j*.

Further, regarding the control mechanism 15 of the compressor according to the first and second embodiments, the control valve 15*c* may be provided in the high-pressure passage 15*b*, and the orifice 15*d* may be provided in the low-pressure passage 15*a*. In this case, the control valve 15*c* is allowed to adjust the flow rate of high-pressure refrigerant flowing through the high-pressure passage 15*b*. This allows the high-pressure in the discharge chamber 35 to promptly increase the pressure in the control pressure chamber 13*b* and to promptly reduce the displacement. Also, the control valve 15*c* may be replaced by a three-way valve connected to the low-pressure passage 15*a* and the high-pressure passage 15*b*. In this case, the opening degree of the three-way valve is adjusted to regulate the flow rate of refrigerant flowing through the low-pressure passage 15*a* and the high-pressure passage 15*b*.

Therefore, the present examples and embodiments are to be considered as illustrative and not restrictive and the invention is not to be limited to the details given herein, but may be modified within the scope and equivalence of the appended claims.

What is claimed is:

1. A variable displacement swash-plate compressor comprising:

a housing having a swash plate chamber and a cylinder bore;

a drive shaft that is rotationally supported by the housing;

a swash plate that is rotational in the swash plate chamber by rotation of the drive shaft;

a link mechanism arranged between the drive shaft and the swash plate, wherein the link mechanism allows an inclination angle of the swash plate to be changed with respect to a direction perpendicular to a drive shaft axis of the drive shaft;

a piston reciprocally received in the cylinder bore;

a conversion mechanism that causes the piston to reciprocate in the cylinder bore by a stroke corresponding to the inclination angle of the swash plate through rotation of the swash plate;

an actuator configured to change the inclination angle; and a control mechanism that controls the actuator, wherein the link mechanism includes:

a lug member that is located in the swash plate chamber and is fixed to the drive shaft; and a transmitting member that transmits rotation of the lug member to the swash plate, the actuator includes:

the lug member;

a movable body that is configured to rotate integrally with the swash plate and to move along the drive shaft axis, thereby changing the inclination angle; and a control pressure chamber that is defined by the lug member and the movable body and is configured such that pressure in the control pressure chamber is changed by the control mechanism to move the movable body, the movable body includes an acting portion that protrudes toward the swash plate and is configured to push the swash plate with the pressure in the control pressure chamber, the swash plate includes a receiving portion that protrudes toward the movable body, wherein the receiving portion contacts and is pushed by the acting portion, the acting portion and the receiving portion contact each other at an acting position, a drive-shaft-parallel line segment is defined that contains the acting position and connects a front end of the acting portion and a rear end of the receiving portion to each other, while extending in parallel with the drive shaft axis, and the drive-shaft-parallel line segment is shorter when the inclination angle is maximized than when the inclination angle is minimized.

2. The variable displacement swash-plate compressor according to claim 1, wherein the movable body has a movable body surface, which faces the swash plate, the swash plate has a swash plate surface, which faces the movable body surface, the front end of the acting portion is located on the movable body surface, and the rear end of the receiving portion is located on the swash plate surface.

3. The variable displacement swash-plate compressor according to claim 1, wherein an acting plane is defined that contains the acting position and is perpendicular to the drive shaft axis, the acting portion has an inclined section, which is inclined in relation to the acting plane, and when the inclination angle is changed, the acting position is moved on the inclined section.

4. The variable displacement swash-plate compressor according to claim 1, wherein the receiving portion includes an accommodating section, which is recessed toward the rear end of the receiving portion, and when the inclination angle is maximized, a part of the acting portion is accommodated in the accommodating section.

5. The variable displacement swash-plate compressor according to claim 1, wherein a bottom dead center associated part for positioning the piston at a bottom dead center is defined on the swash plate, and when the inclination angle is minimized, the acting position is located at a position shifted closer to the bottom dead center associated part than the drive shaft axis.

6. The variable displacement swash-plate compressor according to claim 5, wherein, as the inclination angle is increased, the acting position is moved in a direction from the bottom dead center associated part toward the drive shaft axis.

7. The variable displacement swash-plate compressor according to claim 1, wherein the swash plate has a through hole, which slides on an outer circumference of the drive shaft in response to changes in the inclination angle, and the swash plate is guided by the link mechanism and the through hole along the drive shaft axis and in a direction of the inclination angle, thereby changing the inclination angle.

8. The variable displacement swash-plate compressor according to claim 7, wherein the movable body includes:

a movable body main portion, which slides on an outer circumference of the drive shaft along the drive shaft axis; and a movable body weight, which extends from the movable body main portion toward the swash plate, the swash plate includes:

a swash plate main portion, which actuates the conversion mechanism and has the through hole; and a swash plate weight, which extends from the swash plate main portion toward the movable body, the movable body weight functions as the acting portion, and the swash plate weight functions as the receiving portion.

* * * * *